US008218997B2

(12) United States Patent
Fujishiro et al.

(10) Patent No.: US 8,218,997 B2
(45) Date of Patent: Jul. 10, 2012

(54) CLEANING MEMBER, CHARGING DEVICE, PROCESS CARTRIDGE, AND IMAGE FORMING APPARATUS

(75) Inventors: Takatsugu Fujishiro, Tokyo (JP); Hiroshi Saitoh, Inagi (JP)

(73) Assignee: Ricoh Company, Ltd., Tokyo (JP)

( * ) Notice: Subject to any disclaimer, the term of this patent is extended or adjusted under 35 U.S.C. 154(b) by 459 days.

(21) Appl. No.: 12/469,223

(22) Filed: May 20, 2009

(65) Prior Publication Data

US 2009/0297206 A1 Dec. 3, 2009

(30) Foreign Application Priority Data

May 30, 2008 (JP) ..... 2008-142771
Jul. 9, 2008 (JP) ..... 2008-178968

(51) Int. Cl.
*G03G 15/02* (2006.01)
*G03G 21/00* (2006.01)

(52) U.S. Cl. ..... 399/100; 399/353; 399/357

(58) Field of Classification Search ..... 399/99, 399/100, 353, 357
See application file for complete search history.

(56) References Cited

U.S. PATENT DOCUMENTS 3,884,572 A * 5/1975 Bacon et al. ..... 399/129
4,390,268 A * 6/1983 Furuichi et al. ..... 399/348
5,666,596 A * 9/1997 Yoo ..... 399/111
5,799,229 A 8/1998 Yokoyama et al.
6,470,161 B2 10/2002 Fujishiro et al.
6,792,240 B2 * 9/2004 Shida et al. ..... 399/333
6,810,225 B2 * 10/2004 Kitano et al. ..... 399/176
6,928,252 B2 * 8/2005 Takami et al. ..... 399/111
6,961,529 B2 * 11/2005 Kosuge ..... 399/176
7,460,810 B2 * 12/2008 Sampe et al. ..... 399/100
7,463,845 B2 * 12/2008 Suda et al. ..... 399/115
7,477,862 B2 * 1/2009 Takaya et al. ..... 399/100
7,551,879 B2 * 6/2009 Kosuge ..... 399/176
7,574,157 B2 * 8/2009 Ishikawa ..... 399/100
7,668,477 B2 * 2/2010 Honobe et al. ..... 399/100
8,000,627 B2 * 8/2011 Mizuishi et al. ..... 399/100
2005/0191081 A1 * 9/2005 Muraishi et al. ..... 399/100
2007/0183809 A1 * 8/2007 Ishikawa ..... 399/100
2008/0101819 A1 * 5/2008 Nakamura et al. ..... 399/176

FOREIGN PATENT DOCUMENTS

JP 02106780 A * 4/1990
JP 04157483 A * 5/1992
JP 05257372 A * 10/1993
JP 06118770 A * 4/1994
JP 7-140763 6/1995
JP 07168471 A * 7/1995
JP 10245130 A * 9/1998
JP 3356603 10/2002
JP 2003-66807 3/2003

(Continued)

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

A cleaning member includes a core bar, an elastic coating layer, and high-friction coefficient parts provided on both ends of the cleaning member. The high-friction coefficient parts include an elastic material. Outer peripheries of the high-friction coefficient parts are inclined with respect to an axial direction of the core bar. The cleaning member is roller-shaped and is configured to clean a surface of a roller member to be cleaned in contact therewith. A charging device and a process cartridge also include the cleaning member.

11 Claims, 16 Drawing Sheets

FOREIGN PATENT DOCUMENTS

| | | | |
|---|---|---|---|
| JP | 2005-70750 | | 3/2005 |
| JP | 2005165022 A | * | 6/2005 |
| JP | 2006-98476 | | 4/2006 |
| JP | 2006-113199 | | 4/2006 |
| JP | 2006162646 A | * | 6/2006 |
| JP | 2007-140167 | | 6/2007 |
| JP | 2007-171381 | | 7/2007 |

* cited by examiner

CLEANING MEMBER, CHARGING DEVICE, PROCESS CARTRIDGE, AND IMAGE FORMING APPARATUS

BACKGROUND OF THE INVENTION

1. Field of the Invention

The present invention relates to a cleaning member configured to remove a contaminant adhered onto a roller surface, a charging device equipped with the cleaning member, a process cartridge, and an image forming apparatus.

2. Description of the Related Art

In an electrophotographic image forming apparatus, a charging roller is widely used as a charging unit configured to apply electric charge to a surface of a latent electrostatic image bearing member (hereinafter, also referred to as a photoconductor, image bearing member, or latent image bearing member). The charging roller is used in a contact system in which an elastic roller is contacted with a photoconductor, or a non-contact system in which gap formation members are provided on both ends of a roller having rigidity or high hardness so as to be apart from the charging roller from a photoconductor i.e., have a minute gap therebetween.

A photoconductor is charged by a charging roller, and a latent image is formed on a surface of the photoconductor by optically writing an image thereon. Thereafter, after developing and transferring steps, a residual toner is generally removed by a cleaning unit for photoconductor. As the cleaning unit for photoconductor, a system in which a photoconductor is cleaned only with a blade such as a polyurethane rubber, a system in which a photoconductor surface is supplied with a lubricant in order to improve cleanability, and the like have been known.

The charging roller is contaminated by a small amount of a toner and lubricant passing through the cleaning unit for photoconductor, and its chargeability is decreased over time. For example, when contamination progresses only in a part of the charging roller in an axial direction thereof, the resistance is increased only in the contaminated part, and then the photoconductor is not charged, thereby black streaks occur in an output image.

In order to prevent the charging roller from contamination, it is known a charging-roller cleaning device configured to clean a surface of the charging roller by bringing the charging roller into contact with a roller-shaped member formed of a fiber, such as a brush roller, or an elastic body such as a foam; for example, a cleaning member using a foam containing a melamine compound is proposed in Japanese Patent Application Laid-Open (JP-A) Nos. 2003-66807, 2005-70750 and 2006-113199.

JP-A No. 2003-66807 discloses a foam having a three-dimensional network structure used as a cleaning member, wherein a melamine resin having a fibrous form in a submicron order enters into minute convexoconcaves on an image bearing member or charging member so as to scrape out contamination, and a surface of a cleaned body can be always kept free from contamination.

However, when the linear velocity of the charging roller to be cleaned and that of the cleaning member differ in a contact portion, the contaminant may be imprinted on a surface of the charging roller. In order to prevent a difference in linear velocity between the charging roller and the cleaning member, they may be connected with a gear. However, as both of them substantially vary in outer diameter (component tolerance), the difference in linear velocity therebetween cannot be completely eliminated. Therefore, a contaminant may be imprinted on the surface of the charging roller.

In image forming apparatuses such as copiers, facsimiles, or printers, a latent electrostatic image corresponding to image information is formed on a latent electrostatic image bearing member, i.e. a photoconductor, which has been uniformly charged by a charging device, and processed to be a visible image using a developer such as a toner, and then the visible image is transferred onto and fixed on a recording medium, such as a sheet, thereby obtaining an output image.

Conventionally, as charging devices used in electrophotographic image forming apparatuses such as copiers or printers, non-contact charging devices using corona discharge have been often used. However, corona products such as ozone, nitrogen oxide and the like are generated by the corona discharge, causing environmental contamination. Moreover a nitric acid compound (ammonium nitrate) produced from a nitrogen oxide adheres to the charging devices, adversely affecting the chargeability.

On the other hand, contact charging devices having a charging roller, of which surface is directly contacted with or placed with a minute gap close to a latent image bearing member, are most commonly used in recent years, because generation of ozone and nitrogen oxides can be considerably reduced.

A charging roller is used, in which an elastic body whose resistance is adjusted, is provided around the circumferential surface of a cored bar, so as to be placed in contact with or placed with a minute gap close to a latent image bearing member, and a charge bias is applied to the charging roller. As for the charge bias, a direct-current voltage, and an alternating-current voltage having an inter-peak voltage whose voltage is twice or greater the discharge starting voltage of the direct current voltage are used, and superimposingly applied to the charging roller. By application of the alternating-current voltage, the potential of the latent image bearing member can converge to a potential of the direct current voltage applied thereto. As a result, the latent image bearing member surface can be uniformly charged.

However, in such contact charging device, the charging roller is arranged so as to face the latent image bearing member surface which has been subjected to a cleaning step. However, a toner or paper powder remaining on the latent image bearing member surface after the cleaning step tends to adhere onto the charging roller. When the charging roller is partly contaminated, the surface resistance is changed. As a result, the latent image bearing member cannot be uniformly charged.

Consequently, the following techniques of cleaning rollers have been proposed.

For example, JP-A Nos. 2007-171381 and 2007-140167 propose a technique in which an elastic cleaning roller is bitten into a charging roller so as to be rotated according to the rotation of the charging roller, thereby preventing the charging roller from contamination.

The technique has an advantage that a distance between the axis of the charging roller and the axis of the cleaning roller is adjustable, the linear pressure (nip width) can be set constant, and is free from influence of a variation of the roller diameter and change over time. Moreover, a driving unit is not necessary, so that the cost and size of an image forming apparatus can be downsized. On the other hand, the technique has a disadvantage that the drive transmission is not kept stable and that the charging roller slips because the cleaning roller is driven by a frictional force between the charging roller and the cleaning roller.

Moreover, Japanese Patent (JP-B) No. 3356603 and JP-A No. 7-140763 propose a technique in which an elastic cleaning roller is bitten into a charging roller and driven using a driving unit, so as to prevent the charging roller from defacement caused by a difference in linear velocity between the charging roller and the cleaning roller.

The technique enables to adjust a linear velocity because the cleaning roller is driven by the driving unit. However, there is a disadvantage that a linear pressure (nip width) varies depending on a variation of the roller diameter and change over time, because the distance between the axis of the charging roller and the axis of the cleaning roller is necessary to be fixed. Moreover, the number of components is increased, and the size of an apparatus becomes larger, compared to the technique of rotation according to the rotation of another member.

It has been known that, in the contact charging device in which an alternating-current voltage is superimposed, the latent image bearing member surface is just like being constantly etched by the charging utilizing a pulse discharge generated in a minute gap provided between a latent image bearing member surface and a charging roller.

When the latent image bearing member surface is abraded due to the pulse discharge of the charging roller, the thickness of a photosensitive layer on the latent image bearing member surface is decreased, i.e. film thickness loss is caused, adversely affecting the chargeability. As a result, image quality may degrade.

In recent years, the film thickness loss of the latent image bearing member is decreased by a method in which the latent image bearing member surface is applied with a solid lubricant such as zinc stearate, so as to form a lubricating layer thereon, thereby enhancing the abrasion resistance.

The film thickness loss of the latent image bearing member is significantly decreased by application of the solid lubricant. However, a part of a toner and paper powder, which have adhered onto the latent image bearing member surface with low frictional properties, tends to pass through a cleaning position along with the lubricant.

The adhesion of the lubricant as well as the toner and paper powder onto the charging roller causes a difference in circumferential velocity between the charging roller and the cleaning roller (JP-B No. 3356603 and JP-A No. 7-140763), and an inappropriate linear pressure of the cleaning roller (JP-A Nos. 2007-171381 and 2007-140167). In these cases, filming occurs on the charging roller, inhibiting the longer operating life of the charging roller.

BRIEF SUMMARY OF THE INVENTION

An object of the present invention is to solve the above problems caused in conventional cleaning units and cleaning devices, and to provide a cleaning member which can avoid the imprinting of a contaminant so as to enhance cleanability.

Moreover, another object of the present invention is to provide a charging device, in which the chargeability may not be decreased due to cleaning failure, a process cartridge and an image forming apparatus, in which abnormal images may not be formed.

Furthermore, still another object of the present invention is to provide a cleaning roller which can obtain excellent cleanability with respect to a roller member, a charging device equipped with the cleaning roller, a process unit, and an image forming apparatus.

The means for solving the aforementioned problems are as follows:

<1> A cleaning member including a core bar, an elastic coating layer, and high-friction coefficient parts provided on both ends of the cleaning member, wherein the cleaning member is roller-shaped and configured to clean a surface of a roller member to be cleaned in contact therewith.

According to the cleaning member described in <1>, the cleaning member does not slip on the roller member to be cleaned, and can be rotated according to the rotation of the roller member without substantially causing a difference in linear velocity because the high-friction coefficient parts are provided on both ends of the cleaning member. Therefore, a contaminant is not imprinted, and the surface of the roller member to be cleaned can be sufficiently cleaned. The cleaning member of the present invention does not need additional mechanisms such as a driving system, and the cost and space are not increased.

<2> The cleaning member according to <1>, wherein the elastic coating layer is formed of a foam containing a melamine compound, and the high-friction coefficient parts are formed by dipping.

The cleaning member described in <2> exhibits excellent cleanability by the foam containing a melamine compound, and the high-friction coefficient parts can be formed at low cost by dipping.

<3> The cleaning member according to <1>, wherein the elastic coating layer is formed of a foam containing a melamine compound, and the high-friction coefficient parts are formed by spray coating.

The cleaning member described in <3> exhibits excellent cleanability by the foam containing a melamine compound, and the high-friction coefficient parts can be formed at low cost by spray coating.

<4> The cleaning member according to <1>, wherein the high-friction coefficient parts contain an elastic material.

In the cleaning member described in <4>, the high-friction coefficient parts are contacted with the roller member so as to increase the frictional force of the cleaning member with respect to the roller member. Consequently, the cleaning roller does not slip on the roller member and can rotate at an absolute constant velocity.

<5> The cleaning member according to <4>, wherein the friction coefficient of the friction coefficient parts with respect to the roller member is larger than the friction coefficient of the cleaning member with respect to the roller member.

The cleaning member described in <5> can effectively increase the frictional force with respect to the roller member.

<6> The cleaning member according to <4>, wherein each of the friction coefficient parts has an outer diameter larger than that of the is cleaning member.

When the cleaning member described in <6> is contacted with the roller member, the friction coefficient parts are compressed and contacted with the roller member, so as to effectively increase the frictional force with respect to the roller member.

<7> The cleaning member according to <4>, wherein the outer peripheries of the friction coefficient parts are inclined with respect to an axial direction of the core bar.

In the cleaning member described in <7>, upon bringing the friction coefficient parts into contact with the roller member, each of the friction coefficient parts is compressed so as to form a wide nip width with respect to the roller member, as the outer periphery of the friction coefficient part is inclined with respect to the axial direction of the core bar. As a result, the frictional force with respect to the roller member is increased.

<8> The cleaning member according to <4>, wherein the elastic material is a rubber.

In the cleaning member described in <8>, the friction coefficient parts can be produced at low cost.

<9> A charging device containing a charging roller being a roller member to be cleaned, and a cleaning member which includes a core bar, an elastic coating layer, and high-friction coefficient parts provided on both ends of the cleaning member, wherein the cleaning member is roller-shaped and configured to clean a surface of the roller member to be cleaned in contact therewith.

By using the charging device described in <9>, the cleanability with respect to the surface of the charging roller is improved to prevent occurrence of an abnormal image due to cleaning failure.

<10> The charging device according to <9>, wherein the high-friction coefficient parts are contacted with a non-image area of the charging roller.

Use of the charging device described in <10> enables to avoid influence of the high-friction coefficient parts on an image formation region. Additionally, the charging device is used to avoid an influence on an image caused by a difference of cleanability at a boundary of the high-friction coefficient parts.

<11> A process cartridge including a photoconductor, and a charging device which contains a charging roller being a roller member to be cleaned, and a cleaning member which includes a core bar, an elastic coating layer, and high-friction coefficient parts provided on both ends of the cleaning member, wherein the cleaning member is roller-shaped and configured to clean a surface of the roller member to be cleaned in contact therewith, and wherein the process cartridge is detachably attached to a main body of an image forming apparatus.

In the process cartridge described in <11>, the charging roller can be sufficiently cleaned, and an abnormal image due to charge failure may not be formed. Moreover, the process cartridge is excellent in handleability so as to improve a life of the device.

<12> An image forming apparatus including a charging device, wherein the charging device includes a charging roller being a roller member to be cleaned, and a cleaning member which includes a core bar, an elastic coating layer, and high-friction coefficient parts provided on both ends of the cleaning member, wherein the cleaning member is roller-shaped and configured to clean a surface of the roller member to be cleaned in contact therewith.

In the image forming apparatus described in <12>, the roller member can be sufficiently cleaned by the cleaning member. Moreover, by using the image forming apparatus, an abnormal image is not formed due to charge failure, and high quality images can be stably formed for a long period.

According to the present invention, the cleaning roller can rotate at an absolute constant velocity without slipping on the charging roller, while the charging roller and the cleaning roller are maintained at a certain linear pressure. Therefore, the cleaning roller can maintain excellent cleanability.

By assembling the cleaning roller of the present invention in a is charging device, the charging roller can exhibit excellent performance for a long period. Moreover, by using the charging device mounted in the process unit or the image forming apparatus, excellent images can be formed for a long period.

DETAILED DESCRIPTION OF THE INVENTION

Hereinafter, embodiments of the present invention will be explained with reference to the drawings. The explanation below is the best mode of the present invention, but not intended to be construed as limiting the scope of the claims of the present invention.

A cleaning member of the present invention is configured to clean a surface of a roller member to be cleaned in contact therewith, and includes at least a core bar and an elastic coating layer, and further includes other layers as necessary.

The elastic coating layer may be formed of a single or a plurality of layers.

As the roller member to be cleaned, a charging roller or the like is used.

Figure 1:
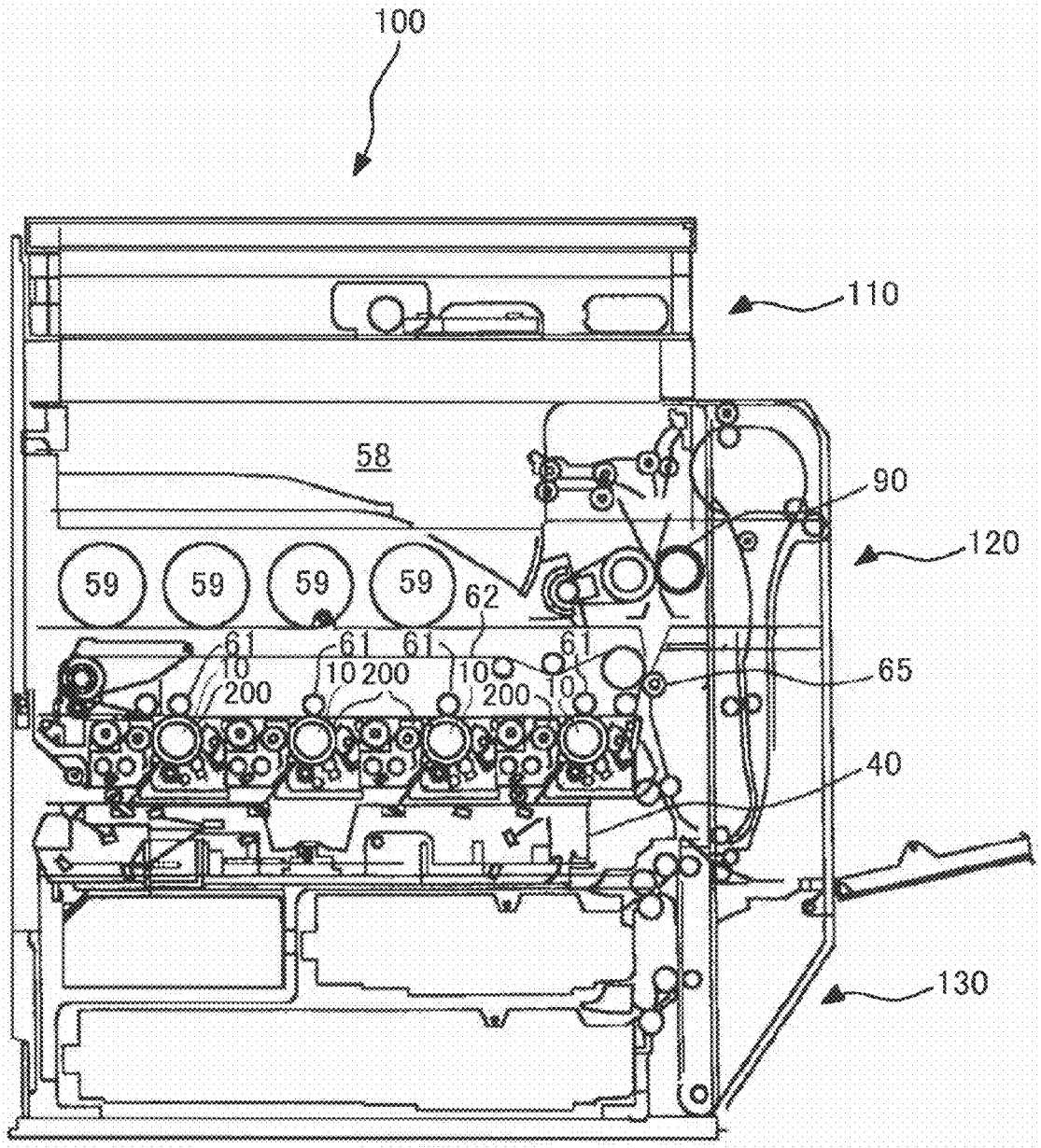
FIG. 1 is a cross sectional diagram schematically showing a configuration of full-color complex machine which is an example of an image forming apparatus including a cleaning member of the present invention.

FIG. 1 is a cross sectional diagram schematically showing a of full-color complex machine which is an example of an image forming apparatus including a cleaning member of the present invention. An image forming apparatus 100 is designed as a copying machine, which includes a document reader 110 located at an upstream side of an apparatus main body 120. The image forming apparatus 100 is a full-color complex machine which serves as a printer and a facsimile as well as a copier.

Figure 2:
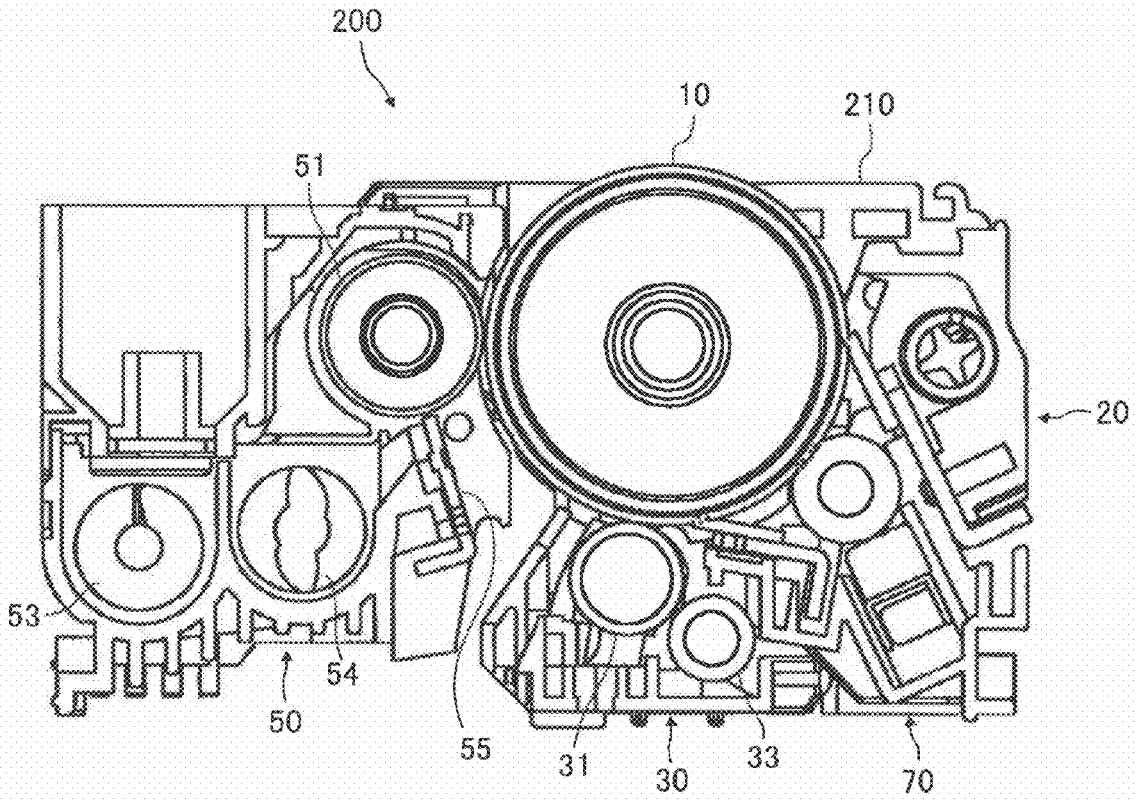
FIG. 2 is a cross sectional view showing an example of a configuration of a process cartridge.

Four process cartridges 200, an endless-intermediate transfer belt 62, a secondary transfer roller 65, toner bottles 59 for each color, which supply a process cartridge with each toner, are arranged in the apparatus main body 120. The process cartridge 200 includes an image bearing member (photoconductor) 10, a cleaning unit 20, a charging unit 30, and a developing unit 50 as shown in FIG. 2.

The intermediate transfer belt 62 is located over the photoconductors 10 (i.e., image bearing members for each color), in which a traveling surface of the intermediate transfer belt 62 is contacted at its lower side with each of circumferential surfaces of the photoconductors 10. The intermediate transfer belt 62 is an example of a transfer member, on which toner images of different colors respectively formed on the surfaces of the photoconductors 10 are superimposingly transferred.

Image forming units, in which toner images are formed on the photoconductors 10, and then transferred onto the intermediate transfer belt 62, have substantially same configurations, which differ in colors of toners. In FIG. 2, the photoconductor 10 is driven to rotate in a clockwise direction so as to charge the photoconductor 10 at a predetermined polarity with the charging unit 30 on which a charging voltage has been applied.

The charged photoconductor 10 is irradiated with an optically modulated laser beam which is emitted from an optical writing device 40 shown in FIG. 1, so as to form a latent electrostatic image on the photoconductor 10. The latent electrostatic image is visualized as a toner image for each color by the developing unit 50.

A primary transfer roller 61 is arranged across the intermediate transfer belt 62 from the photoconductor 10. The primary transfer roller 61 is applied with transfer voltage so as to primarily transfer the toner image on the photoconductor 10 onto the rotating intermediate transfer belt 62. A residual toner adhered onto the photoconductor 10 after the toner image has been transferred is removed by the cleaning unit 20. A lubricant application device 70 is provided downstream of the cleaning unit. The lubricant application device 70 applies the photoconductor 10 with a lubricant, so as to reduce abrasion and to enhance cleanability.

As shown in FIG. 1, a paper feeder 130 having a paper feed cassette which houses a recording medium of transfer paper, is arranged at a lower side of the apparatus main body 120, so as to feed paper, at a predetermined timing, between the intermediate transfer belt 62 and the secondary transfer roller 65 facing thereto. At this time, a power source (not shown) applies a predetermined transfer voltage to the secondary transfer roller 65 so as to secondarily transfer a synthetic toner image on the intermediate transfer belt 62 onto the recording medium.

Throughout all the Figures, same or corresponding elements are generally indicated by same reference numerals.

The recording medium on which the synthetic toner image is secondarily transferred is further conveyed upward, and the toner image is fixed on the recording medium by heat and pressure while being passed through a fixing device 90. The recording medium passed through the fixing device 90 is ejected by a pair of ejecting rollers on a paper ejecting unit 58 which is located at a top side of the apparatus main body 120.

As in the present embodiment, process units such as a cleaning unit, charging unit and developing unit are respectively modularized, and each of the process units can be replaced on a unit basis in a state where the process cartridge 200 is detached from the image forming apparatus main body, thereby preventing waste of resources, specifically, preventing of discarding a process unit which can be still used according to the operating life of the process cartridge. According to the present embodiment, users or servicemen can replace a process cartridge and a process unit on a unit basis, so that the apparatus of the present embodiment is significantly convenient.

FIG. 2 is a cross sectional view showing an example of a configuration of a process cartridge 200.

As shown in FIG. 2, the process cartridge 200 includes at least a photoconductor 10 as an image bearing member and a charging unit 30 in a frame of process cartridge 210 (hereinafter referred to as "frame"). In this embodiment, in addition to a charging unit 30, a cleaning unit 20, a developing unit 50 and a lubricant application device 70 are assembled in the process cartridge. Each of the units is specifically described later.

Figure 3:
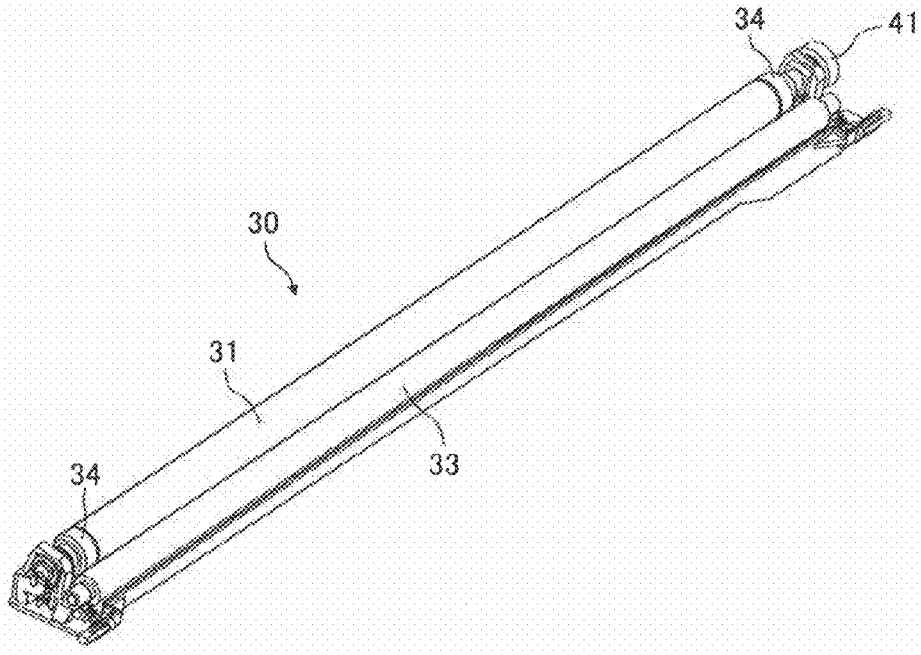
FIG. 3 is a perspective view of an example of a charging unit.
Figure 4:
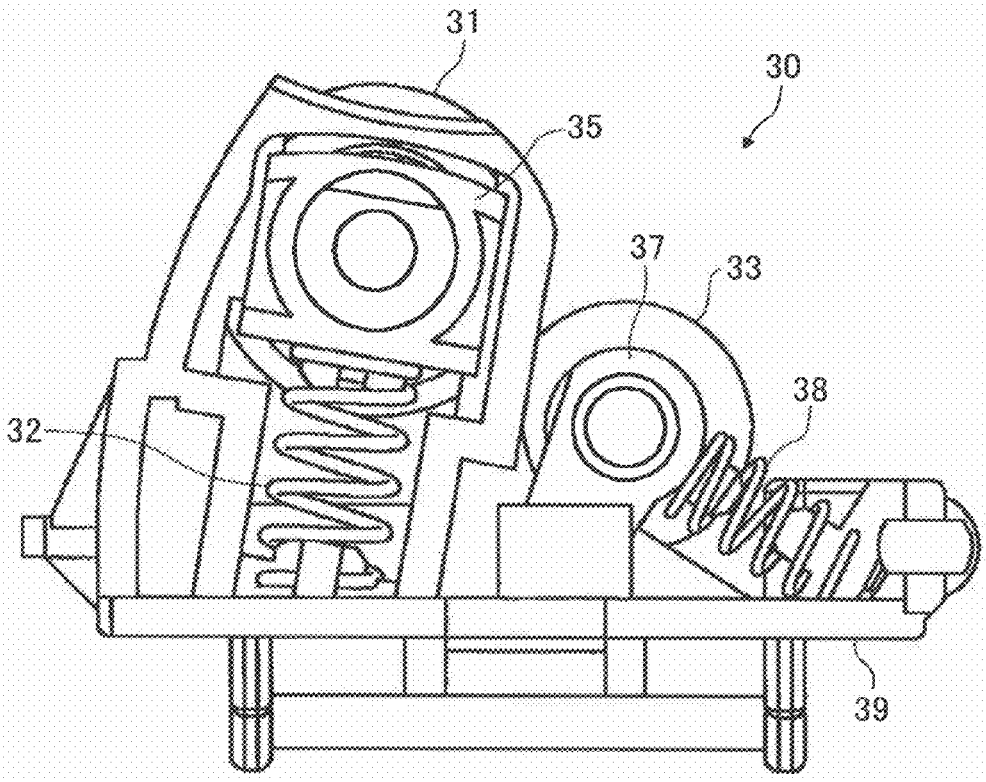
FIG. 4 is a side view of the example of the charging unit.

FIG. 3 is a perspective view of a charging unit 30, and FIG. 4 is a side view of a charging unit 30. As shown in FIGS. 3 and 4, the charging unit 30 includes a charging roller 31 which is a charging member provided facing the photoconductor 10 (FIG. 2), a spring member 32 which is a bias unit configured to prevent oscillation of the charging roller 31, a charging roller-cleaning roller 33 configured to remove contamination of the charging roller 31, a bearing 37 of the cleaning roller 33, a spring member 38 which is a bias unit used to press the charging roller-cleaning roller 33 so as to be contacted with the charging roller 31, a supporting member 35 attached to an edge of the charging roller 31 so as to support the charging roller 31 with respect to a housing of the charging unit 30, and a housing 39 for housing these members.

To one edge of the charging roller 31, a gear 41 is fixed, and the charging roller 31 is driven to rotate by the gear 41. The charging roller-cleaning roller 33 is pivotally supported so as to rotate in accordance with the charging roller 31. The supporting member 35 of the charging roller is pressed to a direction apart from the housing 39 (to a direction toward a drum axis of the photoconductor) by the spring member 32, and a regulating member formed in the housing 39 regulates the movement of the supporting member 35.

As a result of this configuration, when the charging unit 30 is attached to the process cartridge 200, the charging roller 31 keeps a suitable distance from the photoconductor 10 by means of spacer members 34 which are wound around both ends of the roller, and the charging roller 31 is pressed against the photoconductor 10. When the charging unit 30 is detached from the process cartridge 200, the charging unit 30 itself can be singly used. The charging roller 31 is driven by a drive mechanism. Alternatively, the charging roller 31 may be configured to be driven by the drive of the photoconductor 10.

Next, the cleaning member of the present invention will be explained. Here, the case where the charging roller 31 is cleaned as a roller member to be cleaned will be explained.

-First Embodiment-

Figure 5:
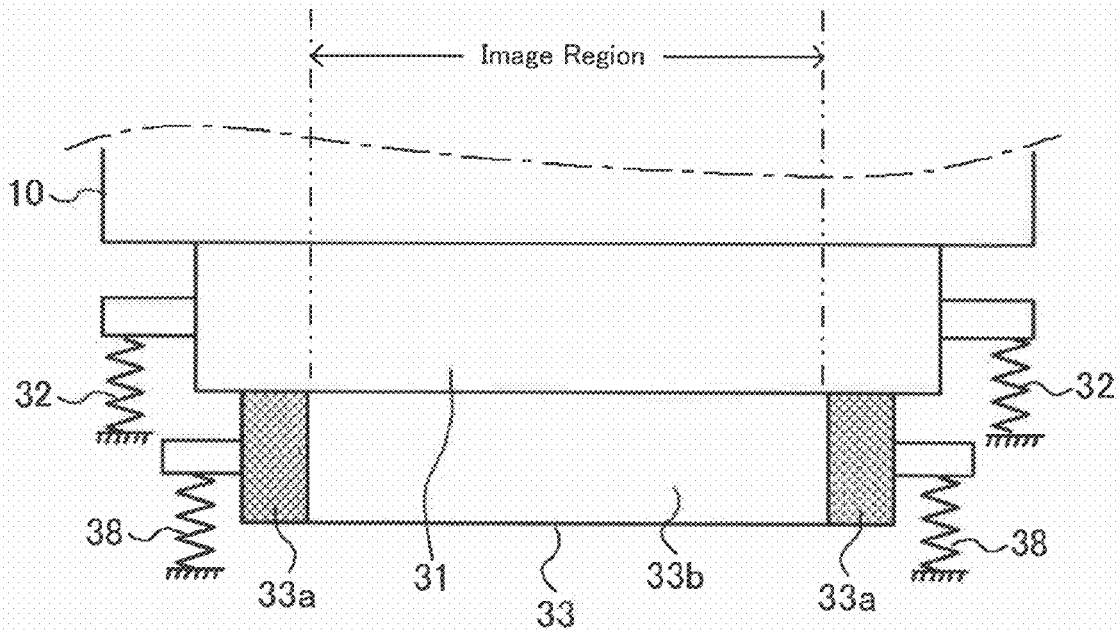
FIG. 5 is a side view schematically showing a contact portion between a photoconductor and a charging unit.

FIG. 5 is a side view schematically showing a contact portion between a photoconductor 10 and a charging unit.

As shown in FIG. 5, a charging roller 31 is biased to be in contact with the photoconductor drum 10 by a spring 32 practically via a bearing, and a charging roller-cleaning roller 33 is also biased to be in contact with the charging roller 31 by a spring member 38.

A charging roller-cleaning roller 33 of the first embodiment is formed in such a manner that a foam containing a melamine compound is formed into an elastic layer in a cylindrical shape on a core bar member, and a resin or the like attached on the foam by dipping or spray coating so as to provide high-friction coefficient parts 33*a* on the both ends. A central part in which the high-friction coefficient parts 33*a* are not provided is a cleaning part 33*b* formed of the foam. The friction coefficient of surfaces of the high-friction coefficient parts 33*a* are greater than that of a surface of the cleaning part 33*b*, in which the charging roller-cleaning roller 33 does not slip on the charging roller 31 and can be rotated followed by the rotation of the charging roller 31. The high-friction coefficient parts 33*a* are provided in a region other than an image formation region (a non-image region). When the charging roller 31 rotates, the charging roller-cleaning roller 33 is rotated followed by the rotation of the charging roller 31, and the cleaning part 33*b* cleans a surface of the charging roller 31. When the charging roller-cleaning roller 33 of the first embodiment is rotated followed by the rotation, the charging roller-cleaning roller 33 can be rotated according to the rotation of the charging roller 31 without substantially causing a difference in linear velocity owing to the high-friction coefficient parts 33*a*.

By providing the high-friction coefficient parts on both ends of the cleaning member of the present invention, the cleaning member does not slip on the roller member to be cleaned, and can be rotated according to the rotation of the roller member without substantially causing a difference in linear velocity. Therefore, a contaminant is not imprinted, and the surface of the roller member to be cleaned can be sufficiently cleaned. The cleaning member of the present invention does not need additional mechanisms such as a driving system, and cost and space are not increased. When the cleaning member of the present invention is used for cleaning the charging roller, the cleanability with respect to the surface of the charging roller is improved to prevent occurrence of abnormal images.

-Second Embodiment-

Figure 6:
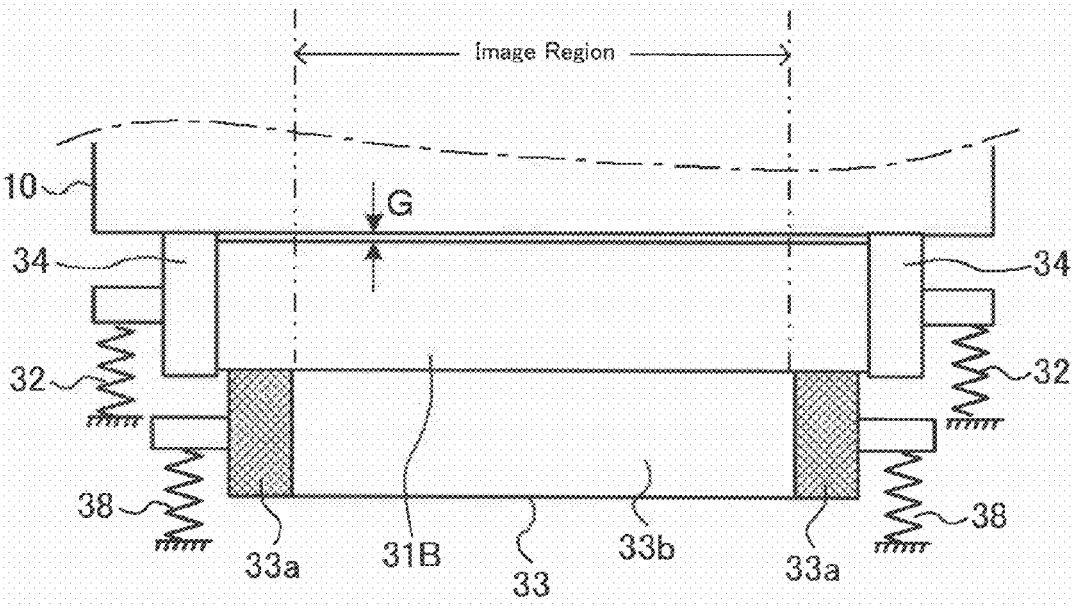
FIG. 6 is a side view showing another example of the configuration of the charging roller.

FIG. 6 shows a second embodiment of the configuration of the charging roller. A charging roller 31B shown in FIG. 6 has spacer members 34 on both ends of the roller so as to form a charge gap (minute gap) G between a charging roller 31B and a photoconductor 10. A charging roller-cleaning roller 33 in the figure is the same as the charging roller-cleaning roller of FIG. 5, in which high-friction coefficient parts 33*a* are provided in a region other than an image formation region (a non-image region). Thus, the charging roller-cleaning roller 33 can be rotated according to the rotation of the charging roller in a system including the charge gap (minute gap), without substantially causing a difference in linear velocity. Therefore, a contaminant is not imprinted, and the surface of the roller member to be cleaned can be sufficiently cleaned.

-Third Embodiment-

Figure 7:
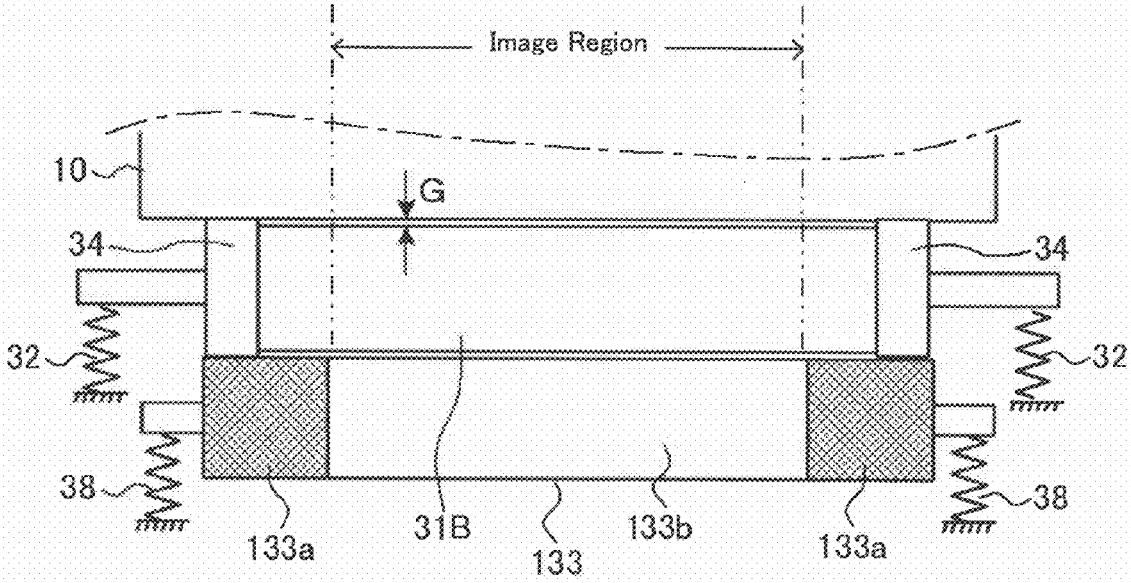
FIG. 7 is a side view showing an example of a cleaning member.

FIG. 7 shows a third embodiment of the cleaning member, which is a charging roller-cleaning roller in a system including a charge gap (minute gap).

A charging roller 31B shown in FIG. 7 is the same as that of FIG. 6. However, a charging roller-cleaning roller 133 of the third embodiment extends its length in a direction of a roller axis so long enough to be in contact with spacer members 34 on both ends of the charging roller 31B. Then, high-friction coefficient parts 133*a* are provided on both ends of the charging roller-cleaning roller 133 so as to be in contact with the spacer members 34 of the charging roller. The configuration of the cleaning roller is the same as that of the first embodiment, and is formed in such a manner that a foam containing a melamine compound is formed in a cylindrical shape on a core bar member, and a resin and the like attached on the foam by dipping or spray coating so as to provide the high-friction coefficient parts 133*a* on the both ends. A central part is a cleaning part 133*b* and the high-friction coefficient parts 133*a* are provided in a region other than an image formation region (a non-image region), in the same manner as in FIG. 6.

Similar to the charging roller-cleaning roller 33 in the first embodiment, the charging roller-cleaning roller 133 of the third embodiment can be rotated according to the rotation of the charging roller 31B without substantially causing a difference in linear velocity, during rotation of the charging roller 31B. Therefore, a contaminant is not imprinted, and the surface of the roller member to be cleaned can be sufficiently cleaned. In the case where a contaminant such as dust attaches to the spacer member 34 of the charging roller, the contaminant adheres onto the high-friction coefficient parts 133*a* of the charging roller-cleaning roller 133. Therefore, the charge gap (minute gap) G does not vary, and the chargeability of the charging roller can be maintained, thereby stably forming high quality images for a long period.

Figure 8:
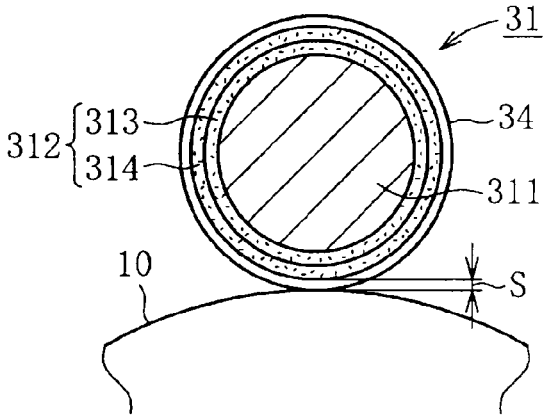
FIG. 8 is a schematic view showing an example of a configuration of a charging roller.

FIG. 8 is a schematic view showing an example of a configuration of a charging roller 31. The charging roller 31 consists of an axis part of a metallic core bar 311 as a core; and a main body part 312 consisting of a middle resistance layer 313 around the axis part 311 and a surface layer 314 as the outermost layer. The axis part 311 having a diameter of 8 mm to 20 mm and is formed of a metal having high rigidity and conductivity, such as stainless-steel or aluminum, or a conductive resin having a rigidity at a volume resistivity of $1\times10^3$ Ω·cm or less, and preferably $1\times10^2$ Ω·cm or less. The middle resistance layer 313 preferably has a thickness of approximately 1 mm to 2 mm at a volume resistivity of $1\times10^5$ Ω·cm to $1\times10^9$Ω·cm. The surface layer 314 preferably has a thickness of approximately 10 μm at a volume resistivity of $1\times10^6$ Ω·cm to $1\times10^{12}$ Ω·cm. The volume resistivity of the surface layer 314 is preferably higher than the volume resistivity of the middle resistance layer 313. Here, the main body part 312 has a configuration of two layers consisting of the middle resistance layer 313 and the surface layer 314. However, the main body part 312 is not limited to the configuration of two layers, and may be a configuration of a single layer, three layers, or the like.

In FIG. 8, a gap S between the charging roller 31 and the photoconductor 10 is adjusted by the spacer member 34 so as to be 100 μm or less, particularly in a range from 20 μm to 50 μm. Thus, formation of an abnormal image can be suppressed during operation of the charging unit 30. The gap S may be adjusted by providing a fitting part in the frame of process unit 210 for fixing the process unit 200 and the charging unit 30. The charging roller 31 is pressed in a direction of the surface of the photoconductor 10 by the spring member (not shown), which is arranged in a bearing formed of a resin having a low friction coefficient. Therefore, a constant gap can be formed even though mechanical oscillation or displacement of the core bar occurs.

Figure 9A:
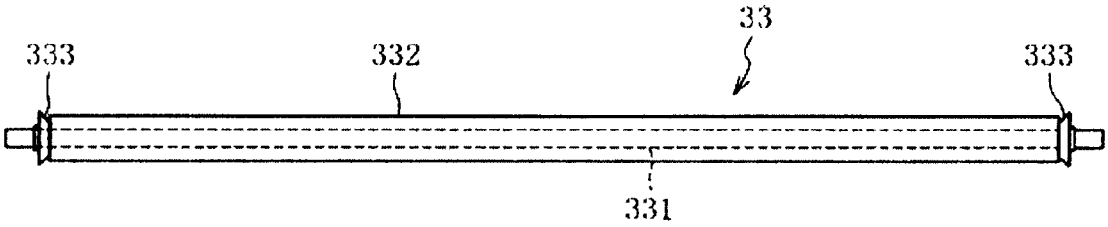
FIG. 9A is an outline view of an example of a configuration of a cleaning roller of the present invention.
Figure 9B:
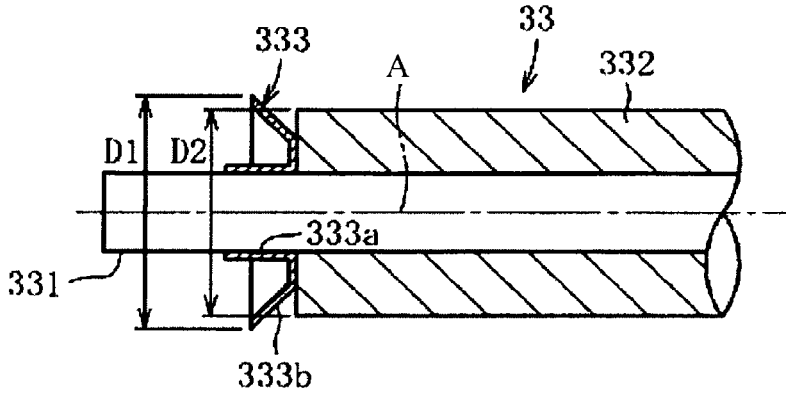
FIG. 9B is an enlarged cross sectional view of a relevant part showing an example of a configuration of the cleaning roller of the present invention.

FIGS. 9A and 9B are schematic views showing examples of the configurations of a cleaning roller 33 as a cleaning member of the present invention. FIG. 9A is an outline view and FIG. 9B is a partial enlarged cross sectional view. The cleaning roller 33 includes a core bar 331, an elastic coating layer 332 for removing a contamination of the charging roller provided on the outer periphery of the core bar 331, and drive transmission members 333 as high-friction coefficient parts provided on both ends of the elastic coating layer 332 so as to transmit the drive from the charging roller. Here, as the elastic coating layer 332, a melamine resin foam having an excellent contamination removal function and an excellent housing function is used. However, a porous sponge or any other materials may be used as long as the above functions are satisfied.

The drive transmission members 333 as the high-friction coefficient parts consist of members having high frictional force with respect to the charging roller (friction member). The friction coefficient of the drive transmission member 333 with respect to the charging roller is set higher than that of the elastic coating layer 332 with respect to the charging roller. The drive transmission member 333 is formed of a material having elasticity (elastic material). In the present invention, an urethane rubber is used in view of ozone resistance and toner resistance. Additionally, other rubbers or materials can be used as long as the above properties are satisfied.

As shown in FIG. 9B, the drive transmission member 333 is a ring-shaped member in which an insertion opening 333a for insertion of the core bar 331 into the center thereof is formed. The outer periphery 333b of the drive transmission member 333 is formed on the edge of the elastic coating layer 332 while inclining with respect to a longitudinal axis A. The outer diameter D1 of the drive transmission member 333 is larger than the outer diameter D2 of the elastic coating layer 332.

Figure 10:
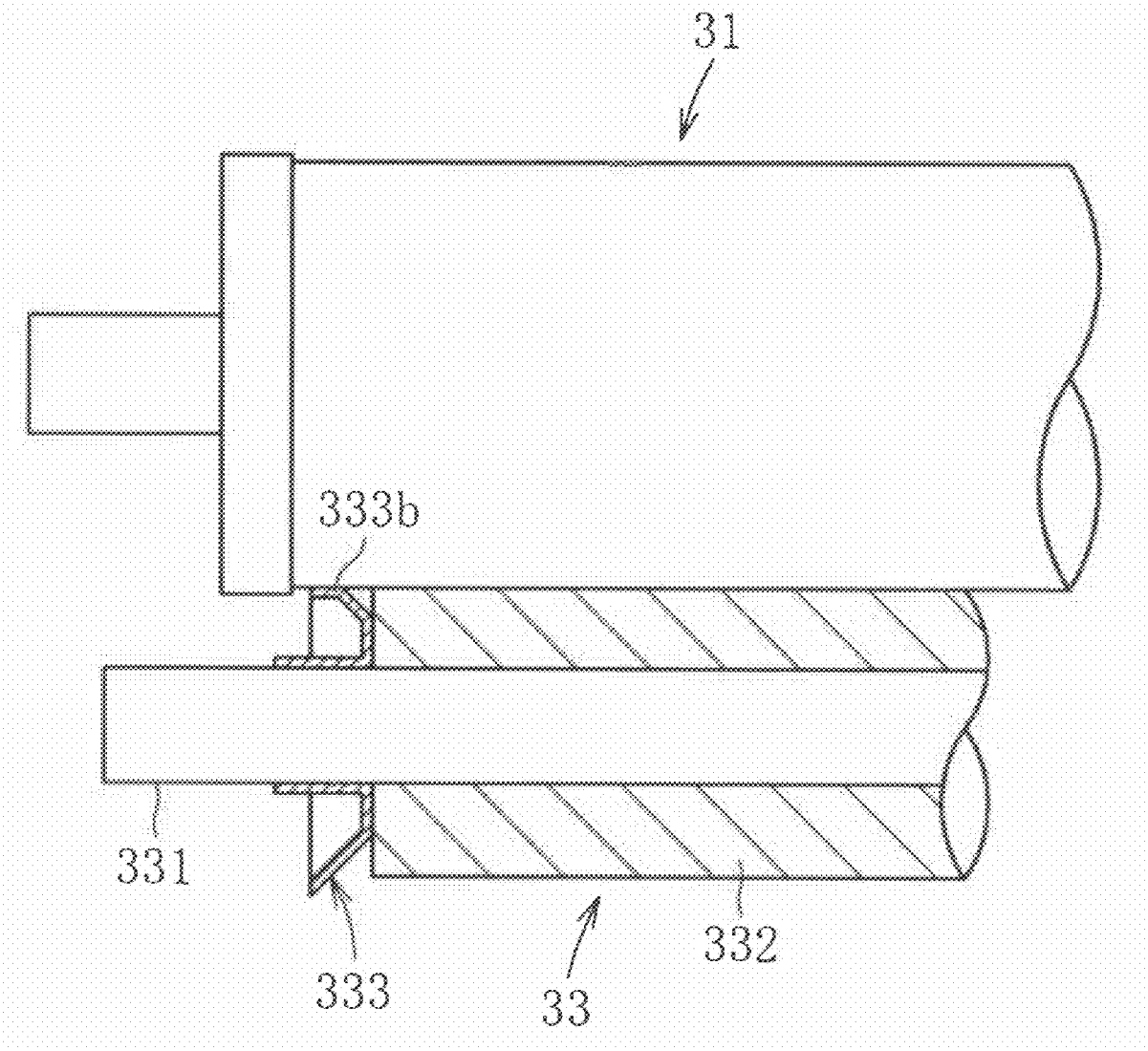
FIG. 10 is a schematic view showing a state where a cleaning roller is contacted with a charging roller.

As shown in FIG. 10, when a cleaning roller 33 is contacted with a charging roller 31 by a pressing force of the spring member (not shown), an elastic coating layer 332 is contacted with the outer periphery of the charging roller 31 to be compressed therewith. An inclined outer periphery 333*b* of a drive transmission member 333 is contacted with the outer periphery of the charging roller 31. The contact portion between the outer periphery 333*b* of the drive transmission member 333 and the charging roller 31 is compressed and elastically deformed. The drive transmission member 333 is compressed to form a wide nip width with respect to the charging roller 31, thereby increasing the frictional force with respect to the charging roller 31. Consequently, when the charging roller 31 rotates and the cleaning roller 33 is rotated according to the rotation of the charging roller 31, the cleaning roller 33 does not slip on the charging roller 31 and can rotate at an absolute constant velocity.

Figure 11:
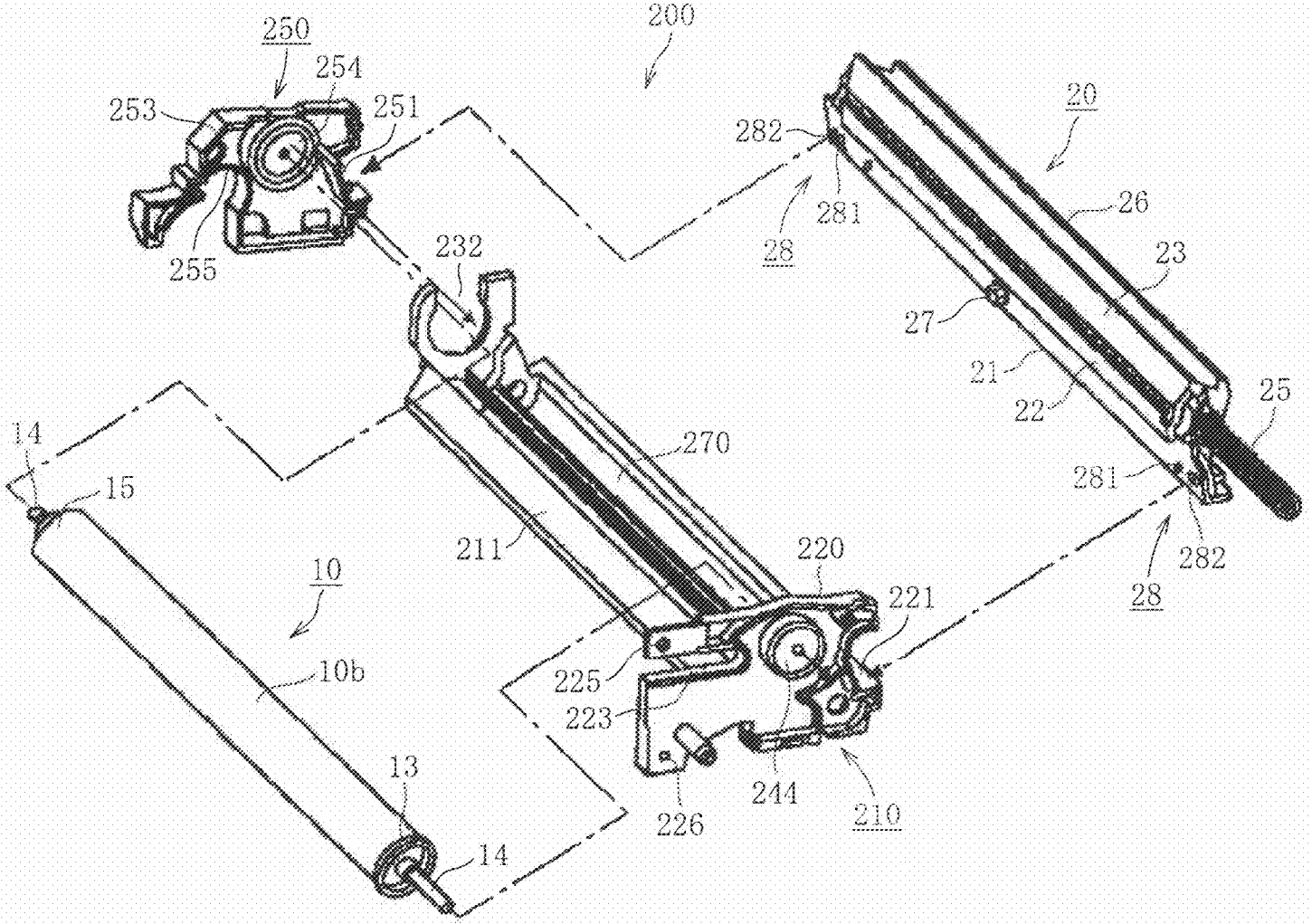
FIG. 11 is an exploded view of a process unit which is an embodiment of the present invention.

FIG. 11 shows an assembly view of a process unit 200.

As shown in FIG. 11, the process unit 200 includes a frame of process unit 210 having a first side plate 220, and a second side plate 250. In an embodiment of the present invention, the process unit 200 is structured by assembling a photoconductor 10, a cleaning unit 20 and the like, using the frame of process unit 210 and the second side plate 250. Hereinafter each member will be specifically explained.

The photoconductor 10 as an image bearing member includes a cylindrical main body part 10*b* having flanges 13, 15 on both ends, from which a rotational axis 14 projects.

The cleaning unit 20 includes a cleaning blade 22 as a cleaning unit, a retention plate 21 for retaining the cleaning blade 22, an inlet seal 23 for sealing the inside a housing 26 so as not to scatter a recycled toner from the photoconductor 10, the housing 26 for housing the recycled toner, and a conveyance auger 25 for conveying the recycled toner in the housing 26 to an image forming apparatus 100. The retention plate 21 fixes the housing 26 with a screw 27 in a substantially intermediate position in a longitudinal direction. On both ends of the retention plate 21, holes 281 and holes for fixation screws 282 are provided as positioning guides 28 for positioning the cleaning unit 20 with respect to the frame of process unit 210 and the second side plate 250. The positioning method is not limited thereto, and a method of pressing an elastic member to a hole or depression part may be used. The means for fixation is not limited to the screws, an E-ring with a rod-like protrusion or the like may be used.

The frame of process unit 210 integrally includes a first side plate 220, a positioning plate 211 used to place the charging unit 30 (not shown), a lubricant application device 70 (not shown), a lubricant housing 270 for housing powder lubricant, and a temporarily placing part 232 used to temporarily place the photoconductor 10 when the photoconductor 10 is assembled.

The first side plate 220 includes a bearing 244 for pivotally supporting the rotational axis 14 of the photoconductor 10, and the first contact surface 221 as a contact portion to contact with the retention plate 21 of the cleaning unit 20. The first side plate 220 includes a guide groove 223 for assembling a developing unit 50 (not shown), and fixation holes 225, 226 for fixing the developing unit 50.

The second side plate 250 includes a second contact surface 251 as a contact portion to contact with the retention plate 21 of the cleaning unit 20, a bearing 254 through which the rotational axis 14 of the photoconductor 10 is passed, a shaft supporting part 253 in which a shaft of a developing sleeve described later is inserted, and a guide groove 255 for guiding a supply member described later. A contact angle of the retention plate 21 of the cleaning unit 20 with respect to the photoconductor 10 is determined by the first contact surface 221 of the first side plate 220 and the second contact surface 251 of the second side plate 250.

With reference to FIG. 11, a method for assembling each member will be explained.

Firstly, one end of the rotational axis 14 of the photoconductor 10 is inserted into a bearing 244 provided in the first side plate 220 and then the other end of the rotational axis 14 of the photoconductor 10 is inserted into the bearing 254 of the second side plate 250. As a result, the photoconductor 10 is supported by the first side plate 220 and the second side plate 250. Next, the retention plate 21 of the cleaning unit 20 is contacted with the contact surface 221 of the first side plate 220 and the contact surface 251 of the second side plate 250, respectively. The rod-like protrusions for positioning (not shown) provided in both contact surfaces 221, 251 are inserted to holes 281 of the positioning guides 28 provided on both ends of the cleaning unit 20. Subsequently, the cleaning unit 20 is fixed in the frame of process unit 210 and the second side plate 250 by the screws inserted though the holes 282 for fixation screw of the cleaning unit 20. Thus, each member can be positioned with high precision by means of fewer components and be assembled with occurring less deformation and deflection.

Hereinafter, other units assembled in the process cartridge 200 of FIG. 2 will be explained.

Figure 12:
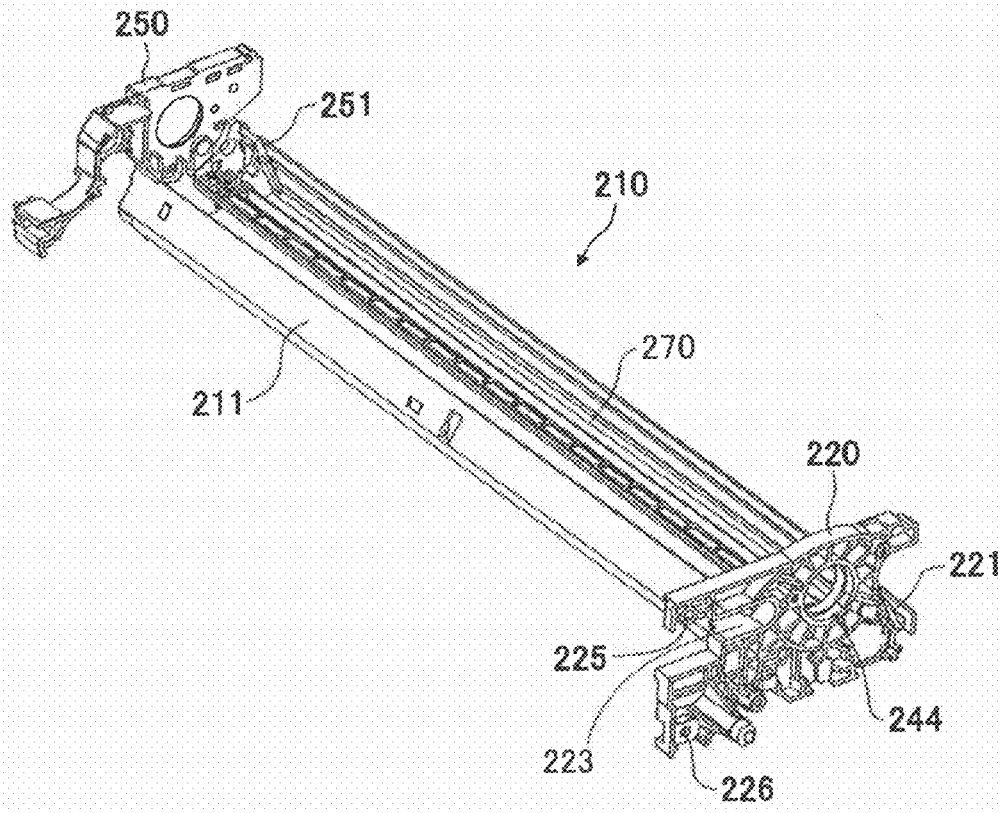
FIG. 12 is a perspective view showing an example of a configuration of a frame of a process cartridge.

FIG. 12 is a perspective view showing a configuration of the frame of process cartridge 210.

The frame of process cartridge 210 is provided so as to integrally include the photoconductor 10 from a first side plate 220 to a second side plate 250, along the longitudinal direction of the photoconductor 10, and further includes a positioning plate 211 for assembling a charging unit (not shown), and an installation part for lubricant application device 270. The first side plate 220 includes a bearing 244 configured to pivotally support the rotational axis 14 (FIG. 13) of the photoconductor projected from the flange 13 (FIG.

13) of the photoconductor 10, a guide groove 223 for assembling a developing unit (not shown), and the fixation holes 225, 226 for fixing the developing unit. The first side plate 220 includes a first contact surface 221 as a contact portion for contact with a retention plate 21 of the cleaning unit described later, and the second side plate 250 includes the second contact surface 251, as well.

Figure 13:
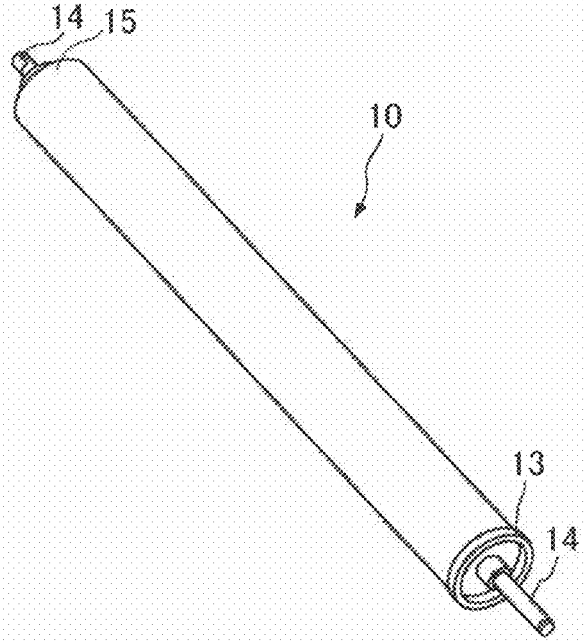
FIG. 13 is a perspective view showing an example of a photoconductor.

FIG. 13 is a perspective view showing an example of a photoconductor 10.

The photoconductor 10 which is a cylindrical image bearing member includes flanges 13, 15 provided on both ends inside the cylindrical shape, through which the rotational axis 14 passes.

Figure 14:
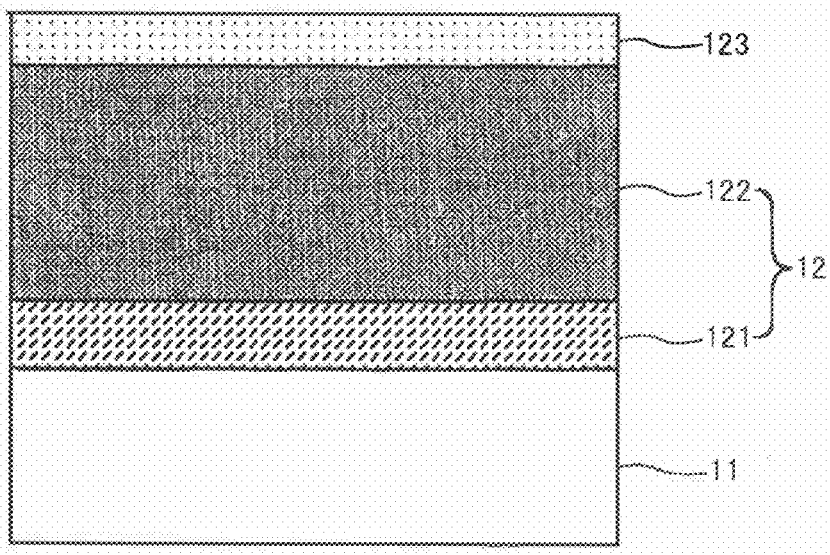
FIG. 14 is a schematic view showing an example of a configuration of a photosensitive layer of a photoconductor.

FIG. 14 is a schematic view showing an example of a configuration of a photosensitive layer of a photoconductor. The photoconductor 10 has a configuration in which a photosensitive layer 12 is provided on a cylindrical aluminum substrate 11. The substrate 11 of the photoconductor 10 may be formed by a method in which a metal such as aluminum, copper, iron, alloys thereof or the like formed into a cylindrical-shaped tube by a solid-drawn process or extrusion process, and the tube is subjected to a surface treatment such as cutting, surperfinishing and grinding so as to be formed into a cylindrical-shaped drum. The photosensitive layer 12 is a layer which mainly contains a charge generating material.

The photosensitive layer 12 consisting of a charge generating layer 121 and a charge transporting layer 122 which transports a generated charge to a photoconductor surface or the substrate 11. The charge generating layer 121 is formed by dispersing the charge generating material, if necessary, with a binder resin, in an appropriate solvent using a ball mill, an attritor, a sand mill or an ultrasonic wave, and applying the dispersion on a conductive support, and then drying. Conventionally known charge generating materials can be used for the charge generating layer 121. Examples of the charge generating materials include monoazo pigments, dis-azo pigments, tris-azo pigments, perylene pigments, perinone pigments, quinacridone pigments, quinone condensation polycyclic compounds, squalic acid dyes, phthalocyanine pigments, naphthalocyanine pigments and azulenium salt dyes. Of these, azo pigments and/or phthalocyanine pigments are effectively used.

The charge transporting layer 122 may be also formed by dissolving and/or dispersing the charge transporting material and a binder resin in an appropriate solvent, and applying the dispersion on a charge generating layer, and then drying. Moreover, a plasticizer, a leveling agent, an antioxidant and the like may be added in the charge transporting material as necessary. The charge transporting material includes an electron hole transporting material and an electron transporting material. Examples of the electron transporting materials include chloranil, bromanil and tetracyanoethylene. Examples of the electron hole transporting materials include poly-N-vinyl carbazole and derivatives thereof, poly-y-carbazolyl ethyl glutamate and derivatives thereof, pyrene-formaldehyde condensate polymers and derivatives thereof, polyvinyl pyrene and polyvinyl phenanthrene. To protect the photosensitive layer 12, a protective layer 123 may be provided on the photosensitive layer 12. In the protective layer 123 a filler may be added in order to improve abrasion resistance. In terms of filler hardness, inorganic materials may be advantageously used. Particularly, silica, titanium oxide and aluminum oxide are effectively used.

Figure 15A:
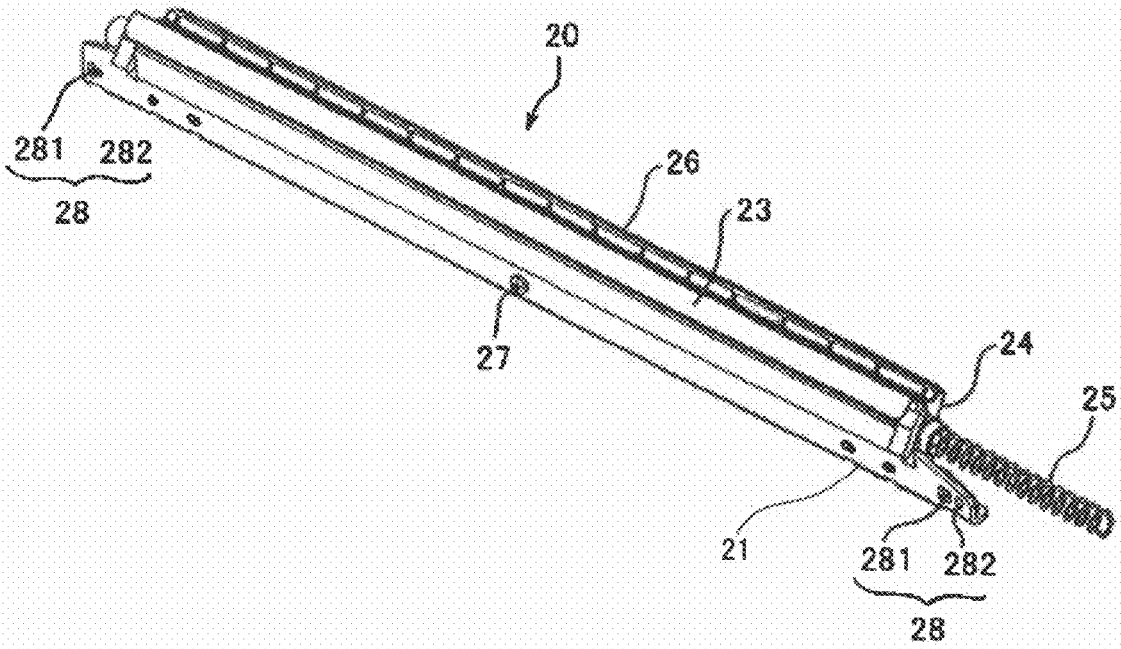
FIG. 15A is an external perspective view showing a schematic configuration of a cleaning unit for a photoconductor.
Figure 15B:
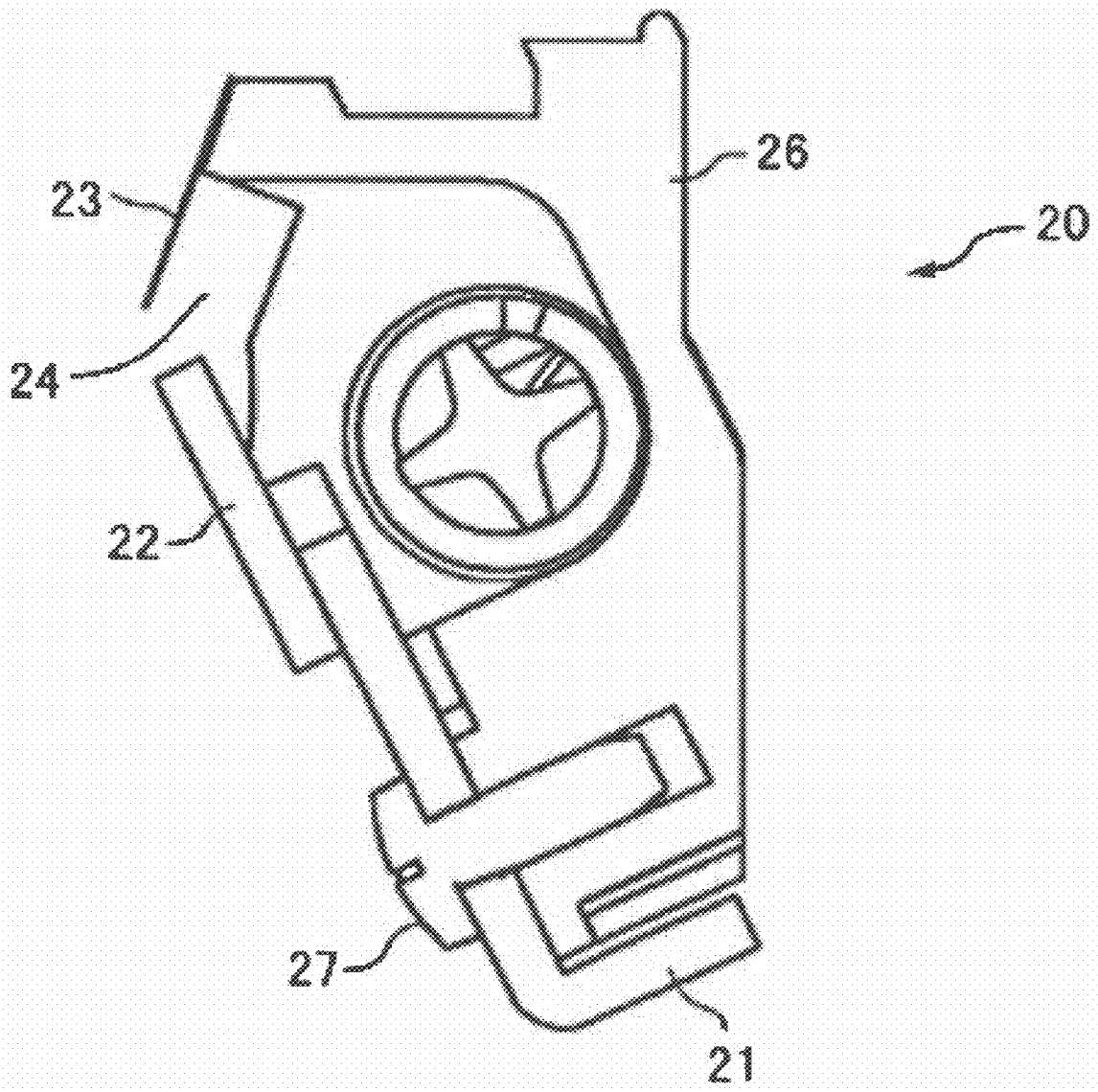
FIG. 15B is a cross sectional view showing a schematic configuration of the cleaning unit for a photoconductor.

FIGS. 15A and 15B show schematic configurations of a cleaning unit for photoconductor 20. FIG. 15A is an external perspective view and FIG. 15B is a cross sectional view.

As shown in FIGS. 15A and 15B, a cleaning unit 20 includes a cleaning blade 22 as a cleaning unit, a retention plate 21 for retaining the cleaning blade 22, an inlet seal 23 for sealing inside a housing 26 so as not to scatter a recycled toner from the photoconductor, the housing 26 for housing the recycled toner, and a conveyance auger 25 for conveying the recycled toner in the housing 26 to an image forming apparatus main body. The retention plate 21 fixes the housing 26 with a screw 27 in a substantially intermediate position in a longitudinal direction.

On both ends of the retention plate 21, holes 281 which correspond to rod-like protrusions for positioning provided in contact surfaces 221, 251 (FIG. 12), and holes for fixation screws 282 are provided. The positioning method is not limited thereto, and a method of pressing an elastic member to a hole or depression part may be used. The means for fixation is not limited to the screws, an E-ring with a rod-like protrusion or the like may be used.

Figure 16A:
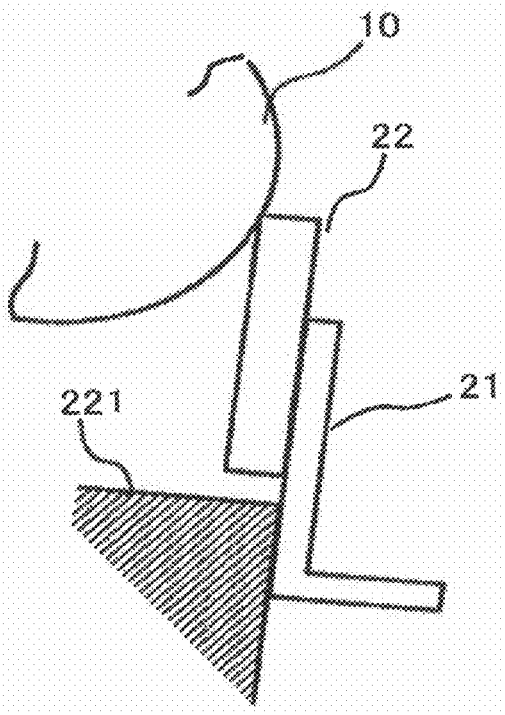
FIG. 16A is a schematic view showing an example of an arrangement of a cleaning blade.
Figure 16B:
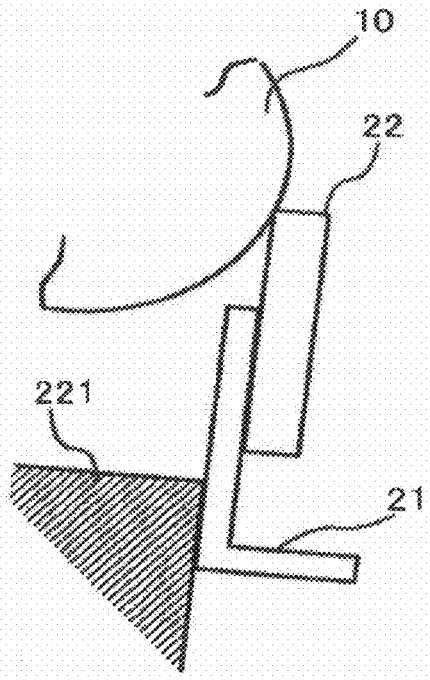
FIG. 16B is a schematic view showing another example of an arrangement of the cleaning blade.

FIGS. 16A and 16B are schematic views showing an arrangement of a cleaning blade 22.

As shown in FIG. 16A, a cleaning blade 22 is fixed in a retention plate 21 in such a manner that a contact surface 221 is located to be in contact with a surface of the retention plate 21 in which the cleaning blade 22 is retained. However, the cleaning blade 22 may be fixed in the retention plate 21 in such a manner that the contact surface 221 is located to contact a surface of the retention plate 21, which is opposite to a surface in which the cleaning blade 22 is retained. However, in the present embodiment the arrangement shown in FIG. 16A is adopted, because the state where the cleaning blade 22 is contacted with a photoconductor 10 is not influenced by the variation of the thickness of the retention plate 21 on which the cleaning blade is fixed. Thus, the cleaning blade 22 can be assembled with high precision.

Here, a contact portion for retaining the both ends of the retention plate 21 which brings the cleaning blade 22 as a cleaning unit in contact with the photoconductor 10, is the contact surface 221. However, it is apparent that the shape of the contact portion is not limited as long as the contact state of the cleaning unit with respect to the photoconductor 10 can be determined.

Examples of materials of the cleaning blade 22 include elastomers such as fluorine rubbers, silicone rubbers and urethane rubbers. Particularly, urethane elastomers are preferred in terms of abrasion resistance, ozone resistance and contamination resistance. The retention plate 21 has an L shape, in order to bring the cleaning blade 22 in contact with the photoconductor with high precision while suppressing the deflection caused by press-contacting the cleaning blade 22 on the photoconductor. The material is a SUS steel plate having a thickness of 2.0 mm and sufficient strength. As the retention plate 21, an iron plate, aluminum plate, and a copper plate such as phosphor-bronze plate may be used. The cleaning blade 22 is bonded to the retention plate 21 by applying an adhesive on the retention plate 21, laminating the cleaning blade 22, and then heating or pressing. However, a double-faced tape or adhesive may be appropriately used for fixation.

Figure 17:
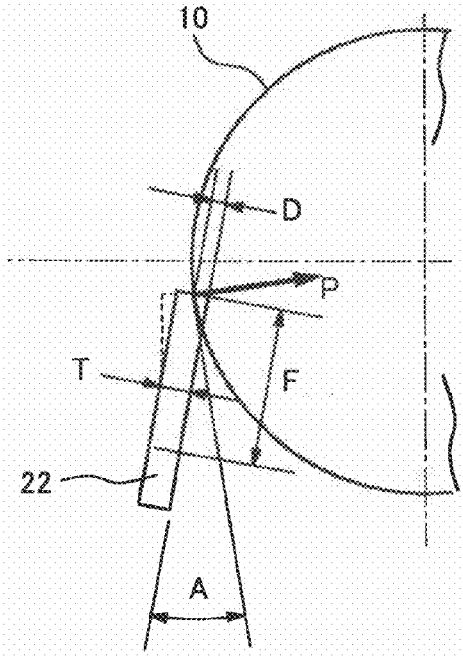
FIG. 17 is a schematic view showing a contact condition of a cleaning blade.

FIG. 17 is a schematic view showing a contact condition of the cleaning blade. As the contact system of a cleaning blade 22 of the present embodiment, a counter system in which a blade is contacted counter to a rotational direction of a photoconductor. Alternatively, a trailing system in which a blade is contacted in the forward direction of a rotational direction. Particularly, the counter system is preferred in terms of high cleanability to a photoconductor 10. The cleaning blade 22 has a hardness of 60° to 85° in accordance with JIS-A. When the hardness is less than 60°, the cleaning blade 22 is largely deformed, and may be hard to clean a toner and the like. When the hardness is more than 85°, the abrasion of the photoconductor 10 increases, thereby shortening a life of an image forming apparatus.

Moreover, the contact pressure of the cleaning blade 22 is preferably 10 gf/cm to 60 gf/cm. When a contact pressure P is less than 10 gf/cm, a toner having a particle diameter of less than 2 μm is hard to be removed. When the contact pressure is more than 60 gf/cm, an end of the cleaning blade 22 may be scraped to curl up or bounding may easily occur, thereby easily causing cleaning failure such as chattering and decreasing cleanability. The cleaning blade 22 preferably has a coefficient of elasticity of 4.5 MPa to 10 MPa, a free length F of 5 mm to 12 mm, a thickness T of 1 mm to 2 mm, and a contact angle A of 5° to 25°, and a contact depth D of 0.1 mm to 2.0 mm. The contact angle of the cleaning blade 22 is preferably 50 to 25° from a tangent line of a contact position. When the contact angle is less than 5°, cleaning failure easily occurs because a toner passes through the cleaning blade. When the contact angle is more than 25°, the blade may be curled up during cleaning.

The contact depth of the cleaning blade 22 against the photoconductor 10 is preferably 0.1 mm to 2.0 mm. When the contact depth is less than 0.1 mm, an area where the cleaning blade 22 is contacted with the photoconductor 10 is small, and a toner passes through the cleaning blade, occurring cleaning failure. When the contact depth is more than 2.0 mm, the frictional force between the cleaning blade and the photoconductor 10 increases, occurring easily curling-up of the blade and bounding. Moreover, cleaning failure, such as squealing caused by blade oscillation, chattering or the like occurs.

Figure 18:
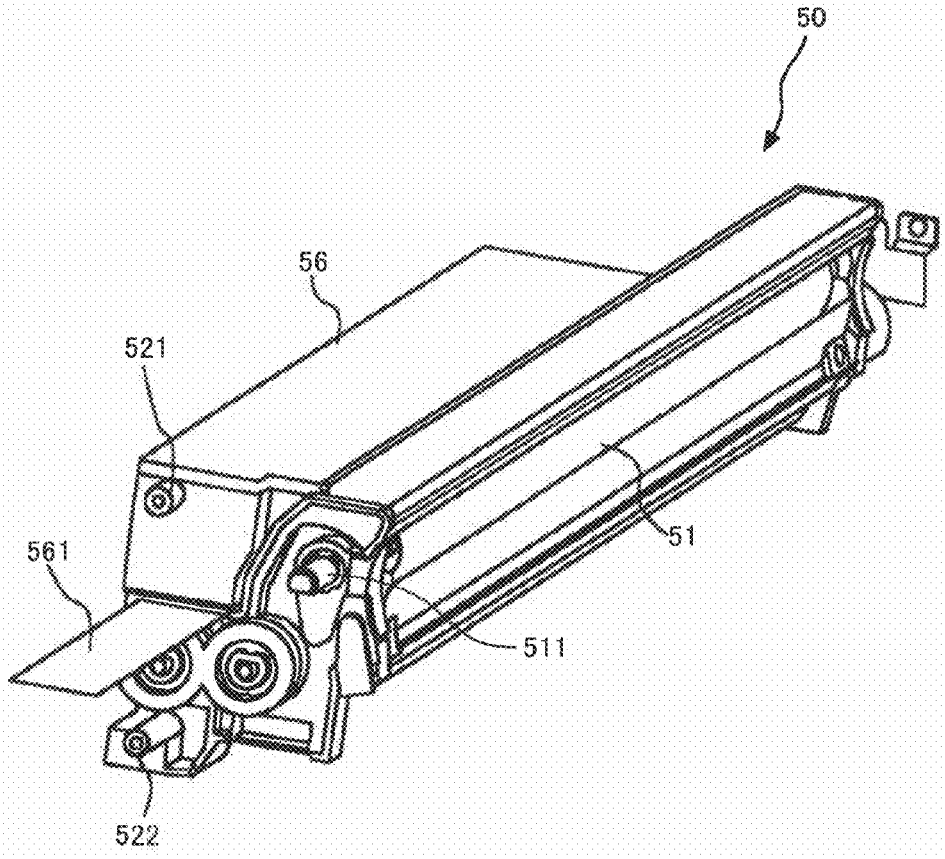
FIG. 18 is a schematic view showing an example of a developing unit.

FIG. 18 is a schematic view showing an example of a developing unit. The cross sectional view of FIG. 18 is shown in FIG. 2. As shown in these Figures, in a developing unit 50, a developing sleeve 51 which is a developer bearing member arranged so as to be closely located to a photoconductor 10, a supply opening (not shown) for supplying a toner to the developing unit 50 in which a developer is stored from a toner bottle and a supply unit arranged outside a process cartridge 200, mixing screws 53, 54 for mixing and stirring a supplied toner and magnetic carrier, and a regulating member 55 for regulating the amount of the developer supplied to the developing sleeve 51 are arranged.

As shown in FIG. 18, the developing unit 50 further includes a rotational axis 511 that rotates the developing sleeve 51, guides 521, 522, which are protrusions provided in upper and lower portions of a main body of the developing unit, for positioning and assembling the developing unit in the process cartridge 200, a partition plate 561 for preventing outside leakage of the developer during conveyance, and a developer housing 56 for housing the developer using the partition plate 561. By sealing with the partition plate 561 provided in the developer housing 56 for housing the developer, the leakage of the developer during conveyance can be prevented, and at the beginning of use, the partition plate 561 is pulled for removal so as to supply the developer from the developer housing 56 to the mixing and stirring screw 53.

The developing sleeve 51, which is a cylindrical shape formed from a non-magnetic material such as aluminum, brass, stainless, a conductive resin or the like, and configured to rotate by a rotation drive mechanism so as to convey the developer by a magnetic pole provided inside. By the regulating member 55 arranged at an upstream side of a developing area in the developer conveyance direction, the height of a chain-shaped developer standing on the developing sleeve 51, namely, the amount of the developer on the developing sleeve 51 is regulated. As the developer, a two component developer consisting of a magnetic carrier and toner, a magnetic one component developer, and a non-magnetic one component developer may be appropriately used. In the case of use of the magnetic one component developer or the non-magnetic one component developer, the developing sleeve can respond by changing its specification.

Figure 19:
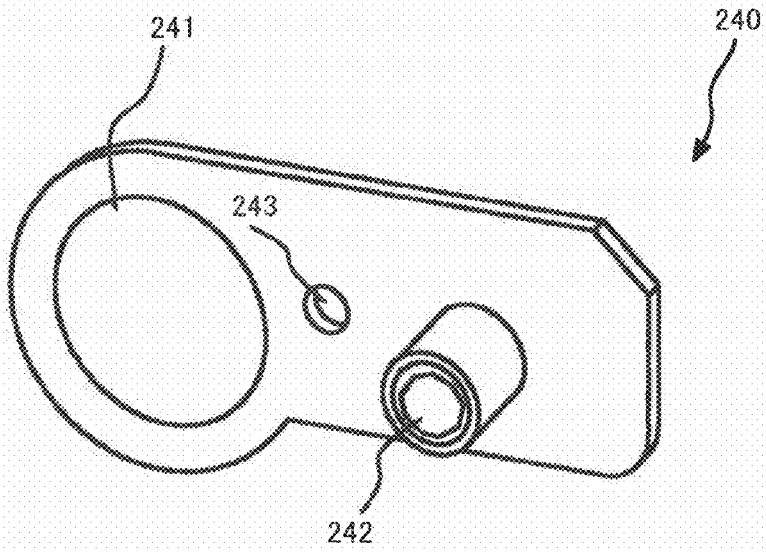
FIG. 19 is a schematic view showing a face plate which positions and fixes a developing unit in a process cartridge.

FIG. 19 is a schematic view showing a face plate for positioning and fixing of a developing unit in a process cartridge. A face plate 240 is fitted into the outer periphery of a bearing 244 which supports the rotational axis 14 of the photoconductor 10 (FIG. 11), and includes a hole 241 which is positioned with respect to the axis of the photoconductor, an insertion part 242 in which the shaft 511 of the developing sleeve 51 of the developing unit 50 (FIG. 18) is inserted, and a hole for screw 243 for fixing of the face plate 240 on the side plate 220 of the frame of process cartridge 210 (FIG. 11).

Figure 20:
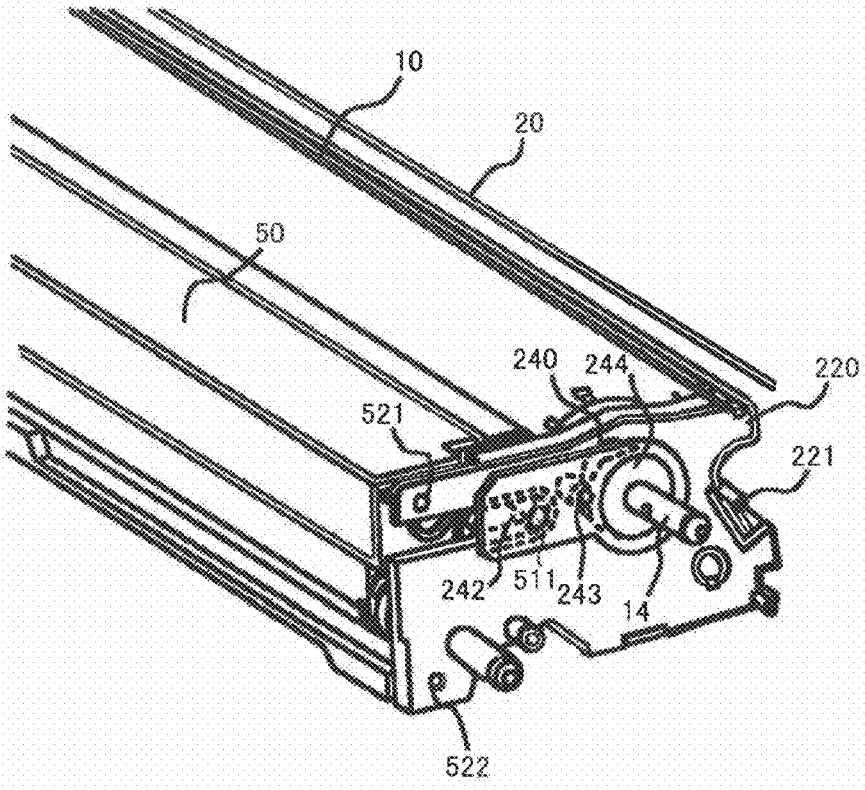
FIG. 20 is a view showing a state where a developing unit is positioned using a face plate with respect to a first side plate of a frame of a process cartridge.

FIG. 20 is a view showing a state where a developing unit is positioned using a face plate with respect to a frame of a process cartridge. As shown in FIG. 20, a rotational axis 14 of a photoconductor 10 is positioned by passing through a bearing 244 which is provided in a first side plate 220 of the frame of process cartridge. In a face plate 240, the hole 241 for positioning (FIG. 19) is fitted into the outer periphery of the bearing 244, and an insertion part 242 is inserted into a shaft 511 of the developing sleeve 51 (FIG. 18) so as to determine the position of the rotational axis 14 of the photoconductor 10 and the developing sleeve 51. After the positioning, guides 521, 522 of the developing unit 50 are fixed in the fixation holes 225, 226 (FIG. 12) so as to fix the developing unit 50 in the frame.

Figure 21:
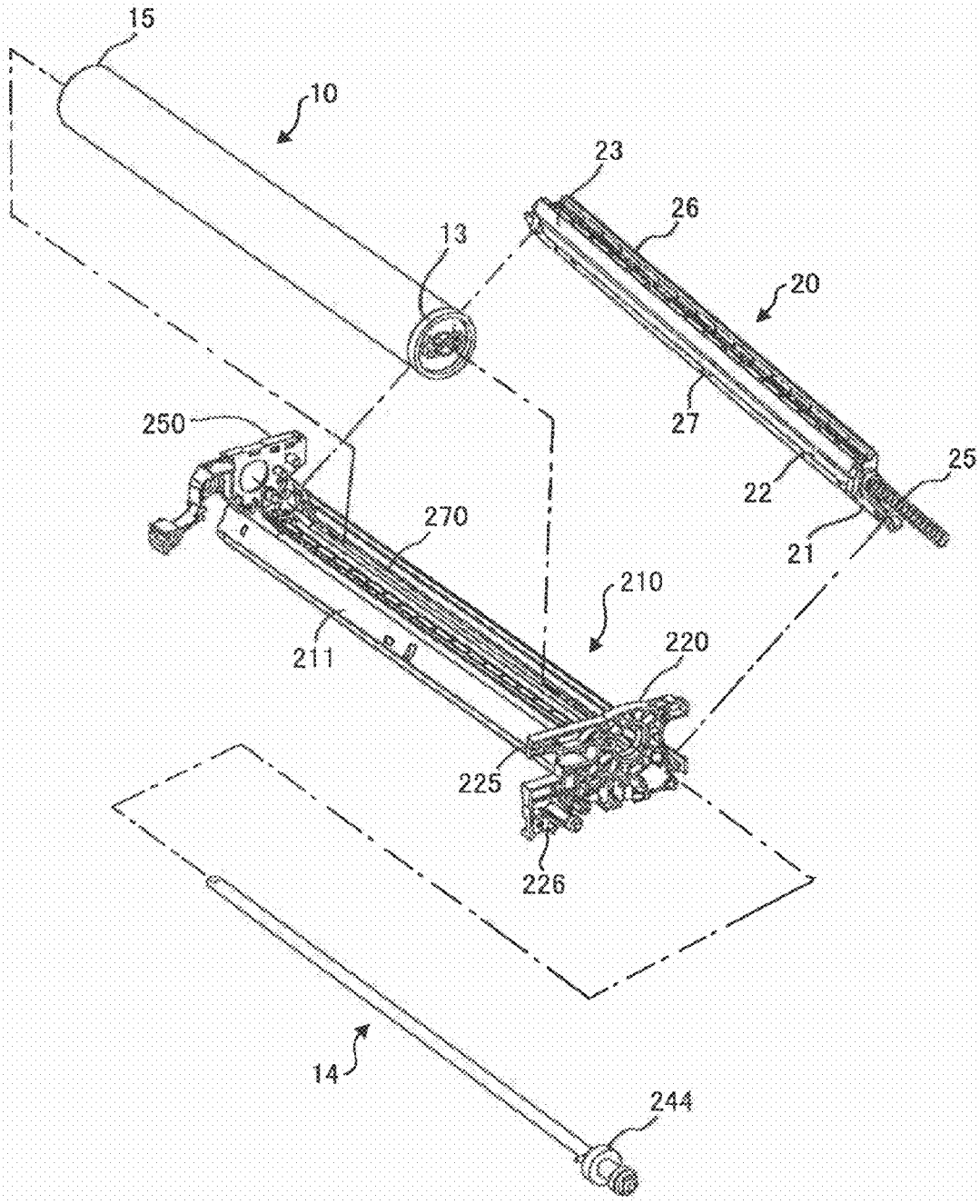
FIG. 21 is an exploded view of an example of a process cartridge.

FIG. 21 is an exploded view of an example of a process cartridge. As shown in FIG. 21, a rotational axis 14 of a photoconductor 10 is inserted into a bearing 244 assembled in a first side plate 220, and the rotational axis 14 of the photoconductor 10 is further inserted into the bearing 254 (FIG. 11) of a second side plate 250 so as to fix the rotational axis 14 of the photoconductor 10 in a frame of process cartridge 210. Further, guide parts 28 provided in a retention plate 21 for retaining a cleaning blade 22 are respectively positioned in the first contact surface 221 (FIG. 11) provided in the first side plate 220, and in the second contact surface 251 (FIG. 11) provided in the second side plate 250, so as to fix the cleaning blade 22 on the frame of process cartridge 210. Thus, each member can be positioned with high precision by means of fewer components and be assembled with causing less deformation and deflection.

Hereinafter, assemblage of each unit and part will be specifically explained.

Figure 22:
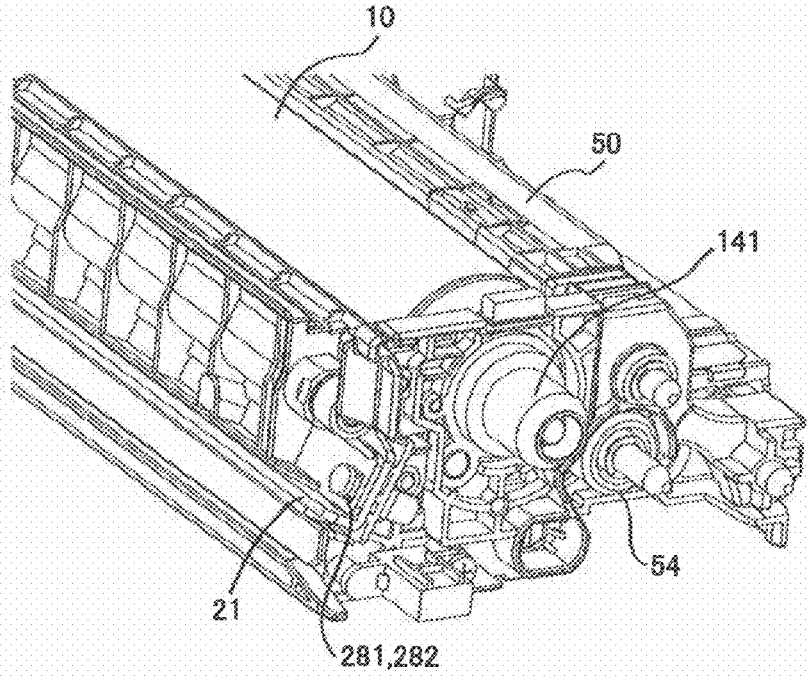
FIG. 22 is a view showing a state where a photoconductor is assembled in a second side plate.

FIG. 22 is a view showing a state where a photoconductor is assembled in a second side plate. As shown in FIG. 22 and FIG. 11, the rotational axis 14 of the photoconductor 10 is inserted into the bearing 254 of the second side plate 250 so as to be positioned, and then a coupling 141 is fixed in an end of the rotational axis 14. The coupling 141 is engaged into a driving unit (not shown) provided in a main body of the image forming apparatus during assembling of the process cartridge 200, and then the photoconductor 10 is driven to rotate. The retention plate 21 of the cleaning unit 20 is contacted with the second contact surface 251 of the second side plate 250, and is guided by the guide 281 as described above and fixed in a fixation hole 282, so as to fix the cleaning unit 20 in the frame of process cartridge 210.

Moreover, a developing unit 50 is fixed in the second side plate 250 by inserting the shaft 511 of the developing sleeve 51 (FIG. 18) into a shaft supporting part 253. As described above, in the first contact surface 221 provided in the first side plate 220 and the second contact surface 251 provided in the second side plate 250, protrusions for positioning and holes for screws are provided so as to fix the retention plate 21 of the cleaning unit 20. Accordingly, the retention plate 21 can be supported on both ends of the process cartridge, that is, the retention plate 21 can be supported in a longitudinal direction with keeping a distance as long as possible, thereby stably retaining the retention plate 21. The cleaning blade 22 assembled in the retention plate 21 can be assembled in the photoconductor 10 with high precision, while keeping excellent contact state therebetween.

The bearings 244 and 254 which support the rotational axis 14 of the photoconductor 10 are respectively located within the width of the first contact surface 221 and the second contact surface 251 and close to the first contact surface 221 and the second contact surface 251, and the retention plate 21 is fixed toward the bearings 244, 254. Therefore, the distance and angle between the retention plate 21 and the rotational axis of the photoconductor supported by the bearings can be more precisely adjusted. As a result, the cleaning blade 22 retained by the retention plate 21 can be assembled in the photoconductor 10 with high precision, while keeping excellent contact state therebetween. As described above, for the retention plate 21 a material having high strength (in this embodiment, a steel plate having a thickness of 2.0 mm) is used so as to increase the precision.

The retention plate 21 is preferably formed of metal so as to have high rigidity. This enables to regulate deformation and deflection caused by a variation of the size of the first side plate 220, the second side plate 250, and the frame of process cartridge 210 when the retention plate 21 of the cleaning blade 22 is fixed at both ends thereof. When the cleaning unit 20 is firstly assembled in the process cartridge 200 using the retention plate 21 having high rigidity, and then the developing unit 50 and the charging unit 30 are assembled therein, the influence of deformation and deflection caused by assembling the cleaning unit is decreased. As a result, the developing unit 50 and the charging unit 30 can be assembled with high precision.

Figure 23:
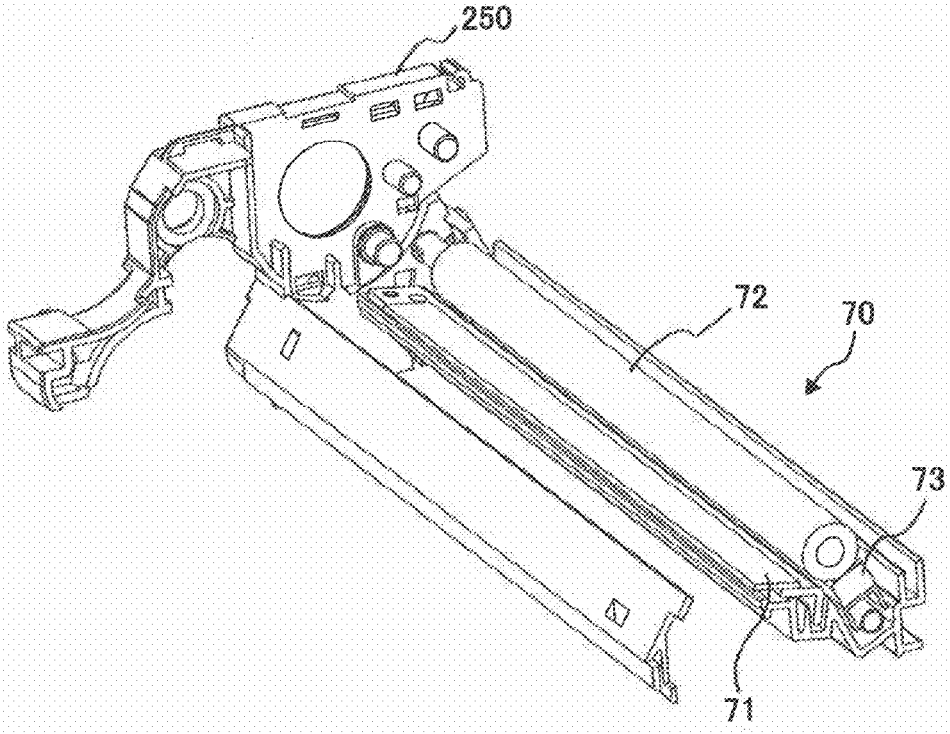
FIG. 23 is a perspective view showing a state where a lubricant application device is assembled.

FIG. 23 is a perspective view showing a state where the lubricant application device is assembled.

As shown in FIG. 2 and FIG. 23, the lubricant application device 70 is provided separately from the cleaning unit 20, and includes a solid lubricant 73, a supply member 72 which includes a brush or the like for supplying the photoconductor 10 with the solid lubricant 73, and a coating blade 71 which is a film formation member for making a film thinner on the photoconductor 10. Examples of the lubricants include fatty acid metal salts such as lead oleate, zinc oleate, copper oleate, zinc stearate, cobalt stearate, iron stearate, copper stearate, zinc palmitate, copper palmitate, zinc linolenate; fluororesins such as polytetrafluoroethylene, polychlorotrifluoroethylene, polyvinyl fluoride, polytrifluorochloroethylene, dichlorodifluoroethylene, tetrafluoroethylene-ethylene copolymers, and tetrafluoroethylene-oxafluoropropylene copolymers. Particularly, more preferred are fatty acid metal salts, which effectively decreases friction of the photoconductor 10 and contains stearic acid as a fatty acid and zinc or calcium as a metal, i.e. zinc stearate or calcium stearate.

Figure 24:
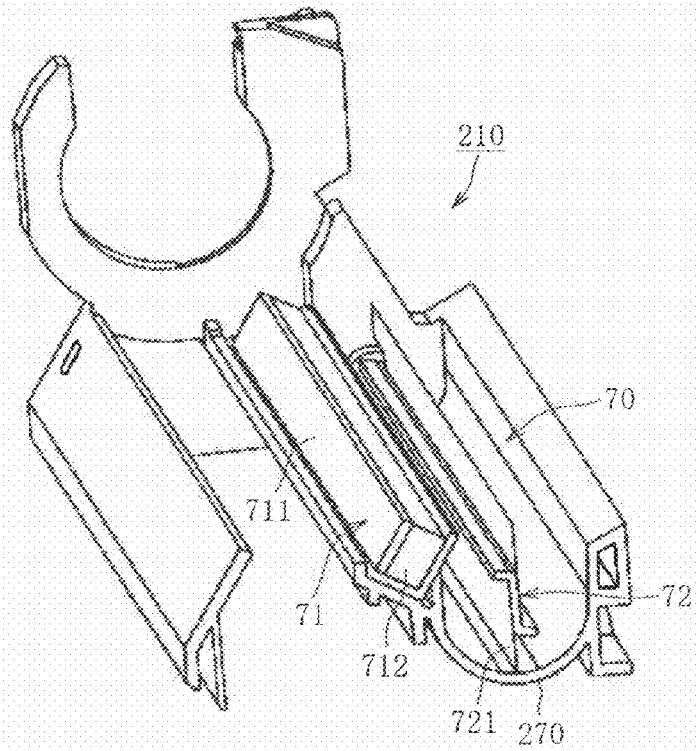
FIG. 24 is a cross sectional view showing an example of a lubricant application device.

FIG. 24 is a cross sectional view showing a lubricant application device 70 housed in a lubricant housing 270 of a frame of process unit 210. With reference to FIG. 24 and FIG. 2, the configuration of the lubricant application device 70 will be explained. The lubricant application device 70 is driven to rotate in the forward direction of a rotational direction of the photoconductor 10, and include a supply member 72 for supplying the photoconductor 10 with the lubricant, a film formation member 71 for forming a thin film of the lubricant which has been supplied to the photoconductor 10, and the lubricant housing 270 for housing the lubricant provided in the frame of process unit 210.

In the present embodiment, the supply member 72 includes a film 721 for supplying the lubricant. The configuration of the supply member 72 is not particularly limited and may be appropriately selected, for example, a brush provided in a metallic roller surface may be used. The film 721 may be selected from the group consisting of a polyester resin, fluorine resin, styrene resin and acrylic resin. Additionally, a polyamide resin having high abrasion resistance and high strength, such as nylon may be used. In order to prevent frictional charge, carbon black such as acetylene black, furnace black; graphite; or a metal powder such as copper, silver or the like as a conductive powder may be contained. Specifically, electrical resistance is preferably $10^2$ Ω·cm to $10^8$ Ω·cm.

The film formation member 71 consists of a coating blade 711 and a blade supporting member 712. The coating blade 711 is an elastomer of a fluorine resin, urethane resin or silicone resin formed into a blade-shape. Particularly, the urethane resin preferably has high elasticity and less abrasion. In the blade supporting member 712, a foam for supporting the coating blade 711 is provided, and the foam is made of a silicone resin, fluorine resin or urethane resin. Particularly, the urethane foam is preferred. Thus, abrasion caused by excessively press-contacting the photoconductor 10 is suppressed and a uniform film of the lubricant can be formed. The contact system of the coating blade 711 to the photoconductor 10 is either a counter system or trailing system. By these systems, curling-up of the blade less occurs and the lubricant can be formed into a uniform thin film. The coating blade 711 has a contact pressure of 5 N/m to 30 N/m, and a contact angle of 10° to 30°.

Other conditions such as the contact depth and the like may be appropriately determined depending on the coefficient of elasticity of the blade. However, the coating blade 711 is used to form a lubricant having low hardness into a thin film, and has a contact pressure lower than that of the cleaning blade during cleaning.

The application device 70 is configured in such a manner that the photoconductor 10 is supplied with the lubricant housed in the lubricant housing 270 through a surface of the film 721 of the supply member 72, and the lubricant is formed into a thin film by the coating blade 711 being contacted with the photoconductor 10. Thus, the friction coefficient of the photoconductor 10 can be decreased to enhance transferability of toner, thereby decreasing the amount of waste toner.

Moreover, a spherically shaped toner which is hard to be removed can be removed by decreasing the friction coefficient of the surface of the photoconductor 10. The thin film of lubricant is formed by the coating blade 711 so as to block an unnecessary amount of lubricant. Thus, the amount of the lubricant for thin film formation is decreased as small as possible so as to form a film having a minimum thickness on the photoconductor 10. A lubricant which has not been formed into a thin film falls off the coating blade 711 and returns to the lubricant housing 270. Thus, the lubricant can be used for a long period.

The lubricant used is powder-shaped and has a volume average particle diameter of 0.1 mm to 3.0 mm. In the case of a shaped lubricant, it is rubbed strongly with a brush and scraped together in the form of powder so as to supply the photoconductor 10 therewith. Thus, the life of the brush may be shortened, and a driving axis and gear must be strengthened. Therefore the cost reduction in production is difficult. By using a powder lubricant, or making the volume average particle diameter of the powder lubricant smaller, the film is easily thinned by the coating blade 711. When the volume average particle diameter is less than 0.1 mm, a lubricant passes through the coating blade 711, and the film is not thinned. When the volume average particle diameter is more than 3.0 mm, the lubricant is removed with the coating blade 711, and the film is not thinned.

Figure 25:
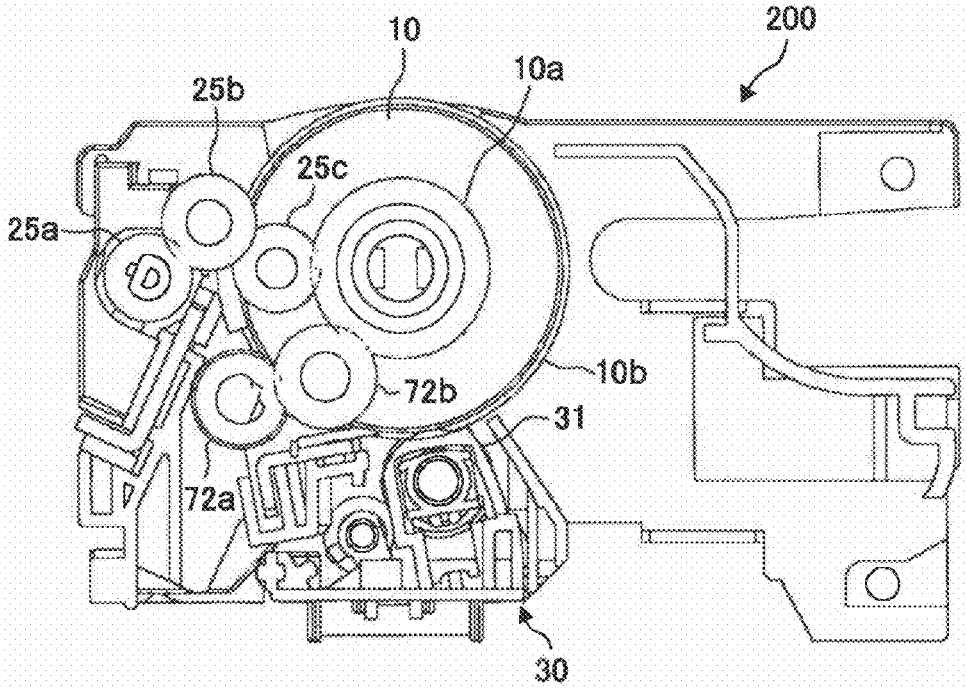
FIG. 25 is a schematic view showing a gear column of a drive system arranged inside a process cartridge.

FIG. 25 is a schematic view showing a gear column of a drive system arranged inside the process cartridge. As described above, a photoconductor 10 is driven to rotate in the image forming apparatus main body. The rotation of a photoconductor gear 10*a* provided in the photoconductor 10 is transmitted via conveyance auger gears 25*a*, 25*b*, 25*c* so as to rotate a conveyance auger 25. The conveyance auger 25 is driven to rotate so as to convey a recycled toner which has been recycled in the housing 26 of the cleaning unit 20 (FIG. 15B) outside the process cartridge. Moreover, the rotation of the photoconductor gear 10*a* is transmitted via transmission gears 72*a*, 72*b* so as to rotate the supply member 72 (FIG. 24), thereby supplying the surface of the photoconductor 10 with the lubricant. Furthermore, the rotation of the photoconductor gear 10*b* is transmitted via a transmission gear (not shown) to the gear 41 (FIG. 3) assembled in the charging roller 31 so as to rotate the charging roller 31, thereby uniformly charging the surface of the photoconductor 10.

The process cartridge 200 may further include a temperature-relative humidity sensor for detecting a temperature and relative humidity inside the process cartridge 200, an electrostatic potential sensor for detecting an electrostatic potential of the photoconductor 10, and a toner concentration sensor for detecting the amount of a toner developed on the photoconductor 10 after developing. Furthermore, a charge eliminating device before transferring, and a charge eliminating device before cleaning may be provided in the process cartridge 200. In the present embodiment, the process cartridge 200 include at least the photoconductor 10 and the charging unit 30, which are integrally supported, and the process cartridge 200 is detachably attached to a main body of the image forming apparatus 100.

The process cartridge 200 of the present invention, as a contaminant is not imprinted on the surface of the charging roller, a high grade image can be stably formed for a long period while maintaining excellent chargeability. The gap between the photoconductor 10 and the charging unit 30 is precisely adjusted so as to suppress generation of ozone and discharge product, thereby extending the life of the photoconductor 10. The cleaning blade 22 can be assembled with high precision, so as to improve cleanability and retard occurrence of a cleaning failure. The cleaning blade 22 is assembled with high precision and has less deformation so as to increase the precision of assembling other process units, and to increase the precision of assembling the developing unit 50, and the precision of a gap between the photoconductor 10 and the developing unit 50. Thus, a high grade image can be obtained. The deflection of the cleaning blade 21 during assembling is prevented to suppress the curling-up of the blade, generation of abnormal sound, such as chattering during image formation. In the image forming apparatus 100 of the present invention, the above-described process cartridge 200 is used so as to stably form a high grade image for a long period.

The rotational speed of the supply member 72 for supplying the lubricant is set faster than that of the photoconductor 10. Therefore, a shortage of the coating amount of the lubricant on the photoconductor 10 does not occur. However, by adjusting a gear ratio, the rotational speed of the photoconductor 10 and that of the supply member are adjusted so as to appropriately set the coating amount of the lubricant.

According to the present invention, as explained with reference to FIG. 10, the drive transmission members 333 having elasticity and high friction coefficient are provided on both ends of the cleaning roller 33 so as to increase a frictional force of the cleaning roller 33 with respect to the charging roller 31. Thus, the cleaning roller 33 can rotate at an absolute constant velocity without slipping on the charging roller 31, while the charging roller 31 and the cleaning roller 33 are maintained at a certain linear pressure. Therefore, the cleaning roller 33 can maintain excellent cleanability, and the charging roller 31 exhibits excellent performance for a long period. Moreover, as the drive transmission member 333, a member having small size and of low cost can be used.

Moreover, the cleaning roller of the present invention is provided in a charging device so as to exhibit excellent performance of the charging roller for a long period. By assembling the charging device in the process unit or the image forming apparatus, an excellent image can be formed for a long period.

So far, the present invention has been explained with reference to the drawings, but the present invention is not limited thereto. For example, the material of the core bar member of the cleaning roller is not limited to metal, and a rigid material can be appropriately used. A material constituting the cleaning part (the melamine foam in the embodiment) can be appropriately selected. As materials for the high-friction coefficient parts, an appropriate material can be used. Moreover, in the embodiment, the roller member to be cleaned is explained as the charging roller. However, the cleaning member of the present invention is not limited to the use for cleaning the charging roller, but can be used for cleaning an appropriate roller member.

Any units may be assembled in the process cartridge. The shape of the image bearing member (photoconductor) is not limited to a drum-shape, and a belt-shaped one or the like may be used.

An image forming unit of the image forming apparatus is arbitrarily configured, and the image forming units for each color in a tandem image forming apparatus are arranged in any order. The image forming apparatus is not limited to the tandem type, and a plurality of developing devices arranged around a photoconductor, a configuration using a revolver developing device or the like may be used. The present invention may be applied to a full-color machine using three color toners, a multi-color machine using two color toners or a monochrome machine. The image forming apparatus is not limited to a digital copier, and may be a printer, facsimile or a complex machine having a plurality of these functions.

What is claimed is:

1. A cleaning member comprising:

a core bar;

an elastic coating layer; and high-friction coefficient parts provided on both ends of the cleaning member, the high-friction coefficient parts include an elastic material, and outer peripheries of the high-friction coefficient parts are inclined with respect to an axial direction of the core bar, wherein the cleaning member is roller-shaped and configured to clean a surface of a roller member to be cleaned in contact therewith.

2. The cleaning member according to claim 1, wherein the elastic coating layer is formed of a foam containing a melamine compound, and the high-friction coefficient parts are formed by dipping.

3. The cleaning member according to claim 1, wherein the elastic coating layer is formed of a foam containing a melamine compound, and the high-friction coefficient parts are formed by spray coating.

4. The cleaning member according to claim 1, wherein a friction coefficient of the high-friction coefficient parts with respect to the roller member is larger than a friction coefficient of the cleaning member with respect to the roller member.

5. The cleaning member according to claim 1, wherein each of the high-friction coefficient parts has an outer diameter larger than that of the cleaning member.

6. The cleaning member according to claim 1, wherein the elastic material is a rubber.

7. The cleaning member according to claim 1, wherein the inclined outer peripheries of the high-friction coefficient parts are configured to transmit a drive force from the roller member to the cleaning member by elastic deformation of the outer peripheries compressed by the roller member.

8. The cleaning member according to claim 1, wherein contact portions of the inclined outer peripheries of the high-friction coefficient parts with the roller member are configured to widen with compression of the inclined outer peripheries.

9. A charging device comprising:

a charging roller being a roller member to be cleaned; and a cleaning member which includes:

a core bar;

an elastic coating layer; and high-friction coefficient parts provided on both ends of the cleaning member, the high-friction coefficient parts include an elastic material, and outer peripheries of the high-friction coefficient parts are inclined with respect to an axial direction of the core bar, wherein the cleaning member is roller-shaped and configured to clean a surface of the roller member to be cleaned in contact therewith.

10. The charging device according to claim 9, wherein the high-friction coefficient parts are contacted with a non-image area of the charging roller.

11. A process cartridge comprising:

a photoconductor; and a charging device which includes:

a charging roller being a roller member to be cleaned; and a cleaning member which includes:

a core bar;

an elastic coating layer; and high-friction coefficient parts provided on both ends of the cleaning member, the high-friction coefficient parts include an elastic material, and outer peripheries of the high-friction coefficient parts are inclined with respect to an axial direction of the core bar, wherein the cleaning member is roller-shaped and configured to clean a surface of the roller member to be cleaned in contact therewith, and wherein the process cartridge is detachably attached to a main body of an image forming apparatus.

* * * * *